US010746498B2

(12) United States Patent
Garretson

(10) Patent No.: US 10,746,498 B2
(45) Date of Patent: Aug. 18, 2020

(54) ARROW REST

(71) Applicant: Timothy J. Garretson, Columbus, NE (US)

(72) Inventor: Timothy J. Garretson, Columbus, NE (US)

( * ) Notice: Subject to any disclaimer, the term of this patent is extended or adjusted under 35 U.S.C. 154(b) by 0 days.

(21) Appl. No.: 16/035,598

(22) Filed: Jul. 14, 2018

(65) Prior Publication Data

US 2019/0353448 A1 Nov. 21, 2019

Related U.S. Application Data

(60) Provisional application No. 62/673,830, filed on May 18, 2018.

(51) Int. Cl.
*F41B 5/14* (2006.01)
*F41B 5/10* (2006.01)

(52) U.S. Cl.
CPC ..... *F41B 5/143* (2013.01); *F41B 5/105* (2013.01)

(58) Field of Classification Search
CPC .. F41B 5/10; F41B 5/066; F41B 5/148; F41B 5/1484; F41B 5/0094; F41B 5/0026; F41B 5/12; F41B 5/123; F41B 5/1403; F41B 3/02
See application file for complete search history.

(56) References Cited

U.S. PATENT DOCUMENTS 4,236,497 A 12/1980 Troncoso, Jr.
4,632,087 A 12/1986 Cline
4,949,699 A 8/1990 Gerber
5,009,215 A * 4/1991 Ludwig ..... F41B 5/143 124/24.1
5,161,515 A * 11/1992 Hammonds ..... F41B 5/143 124/24.1
5,419,303 A 5/1995 Stewart
5,454,362 A * 10/1995 Cook ..... F41B 5/143 124/41.1
5,460,152 A * 10/1995 Specht ..... F41B 5/143 124/44.5
5,606,962 A * 3/1997 Troncoso ..... F41B 5/143 124/24.1
5,673,678 A 10/1997 Savage
(Continued)

OTHER PUBLICATIONS

"BowFinger Medusa Max Arrow Rest", http://www.tenzonearchery.com.au/?_route_=bowfinger-medusa-max-arrow-rest-p951/&filter_tag=Ripcord%20Ace, Retrieved Jul. 2018, 2 pgs.
(Continued)

*Primary Examiner* — Melba Bumgarner
*Assistant Examiner* — Amir A Klayman

(57) ABSTRACT

An arrow rest is moveable between an encapturing configuration and a discharge configuration. The arrow rest comprises a body, a first arm, and a second arm. The first arm is movably mounted with respect to the body. The second arm is also movably mounted with respect to the body. Responsive to movement from the encapturing configuration to the discharge configuration a first portion of the first arm and a first portion of the second arm operate to move away from each other, while a second portion of the first arm and a second portion of the second arm operate to move toward each other.

13 Claims, 33 Drawing Sheets

(56) References Cited

U.S. PATENT DOCUMENTS

| | | | | |
|---|---|---|---|---|
| 5,685,287 | A * | 11/1997 | Greywall | F41B 5/143 124/44.5 |
| 6,021,769 | A | 2/2000 | Troncoso | |
| 6,050,251 | A | 4/2000 | Harwath et al. | |
| 6,561,174 | B1 | 5/2003 | Afshari | |
| 6,634,349 | B2 * | 10/2003 | Mizek | F41B 5/143 124/44.5 |
| 6,637,419 | B1 | 10/2003 | Troncoso, Jr. et al. | |
| 6,789,535 | B1 | 9/2004 | McIntyre | |
| 6,814,068 | B1 * | 11/2004 | Troncoso, Jr. | F41B 5/143 124/44.5 |
| 6,938,616 | B2 | 9/2005 | Walk | |
| 6,948,488 | B2 | 9/2005 | Afshari | |
| 7,337,773 | B2 | 3/2008 | Simo et al. | |
| 7,856,968 | B2 | 12/2010 | Mizek et al. | |
| 7,963,279 | B2 | 6/2011 | Harwath et al. | |
| 8,434,464 | B1 | 5/2013 | Terzo | |
| 8,596,253 | B2 * | 12/2013 | Adams | F41B 5/143 124/44.5 |
| 8,746,224 | B2 | 6/2014 | Khoshnood et al. | |
| 8,960,174 | B2 * | 2/2015 | Khoshnood | F41B 5/143 124/44.5 |
| 9,004,054 | B2 | 4/2015 | Khoshnood | |
| 9,726,453 | B1 | 8/2017 | Hamm et al. | |
| 9,816,776 | B2 | 11/2017 | Ellig et al. | |
| 2008/0168971 | A1 * | 7/2008 | Mizek | F41B 5/143 124/44.5 |
| 2008/0216807 | A1 | 9/2008 | Troncoso | |
| 2009/0183720 | A1 * | 7/2009 | Hudkins | F41B 5/143 124/44.5 |
| 2010/0175675 | A1 * | 7/2010 | Roberts | F41B 5/10 124/25.6 |
| 2011/0139137 | A1 | 6/2011 | Simo et al. | |
| 2011/0168147 | A1 | 7/2011 | Schaffer | |
| 2015/0184972 | A1 * | 7/2015 | Grace | F41B 5/143 124/44.5 |
| 2017/0074614 | A1 | 3/2017 | Nystrom | |

OTHER PUBLICATIONS

"Schaffer Performance Archery, XV Next Generation Arrow rest Performance", schafferarchery.com/arrow-rests/xv/, Retrieved Jul. 2018, 1 pg.

Meyer, "Applications of Physics to Archery", Physics Department, Indiana University, Nov. 6, 2015, 25 pgs.

* cited by examiner

SECTION A - A

ARROW REST

CROSS-REFERENCE TO RELATED APPLICATIONS

This application claims priority to and benefit of U.S. Provisional Patent Application No. 62/673,830 filed on May 18, 2018 entitled "Arrow Rest" by Timothy J. Garretson, and assigned to the assignee of the present application, the disclosure of which is hereby incorporated herein by reference in its entirety.

BACKGROUND

An archer utilizes an arrow rest to assist with positioning an arrow during loading, drawing, and/or shooting of an arrow with a bow. Arrow rests are often attached to a riser of a bow.

BRIEF DESCRIPTION OF DRAWINGS

The accompanying drawings, which are incorporated in and form a part of the Description of Embodiments, illustrate various embodiments of the subject matter and, together with the Description of Embodiments, serve to explain principles of the subject matter discussed below. Unless specifically noted, the drawings referred to in this Brief Description of Drawings should be understood as not being drawn to scale. Herein, like items are labeled with like item numbers.

DESCRIPTION OF EMBODIMENTS

Figure 1A:
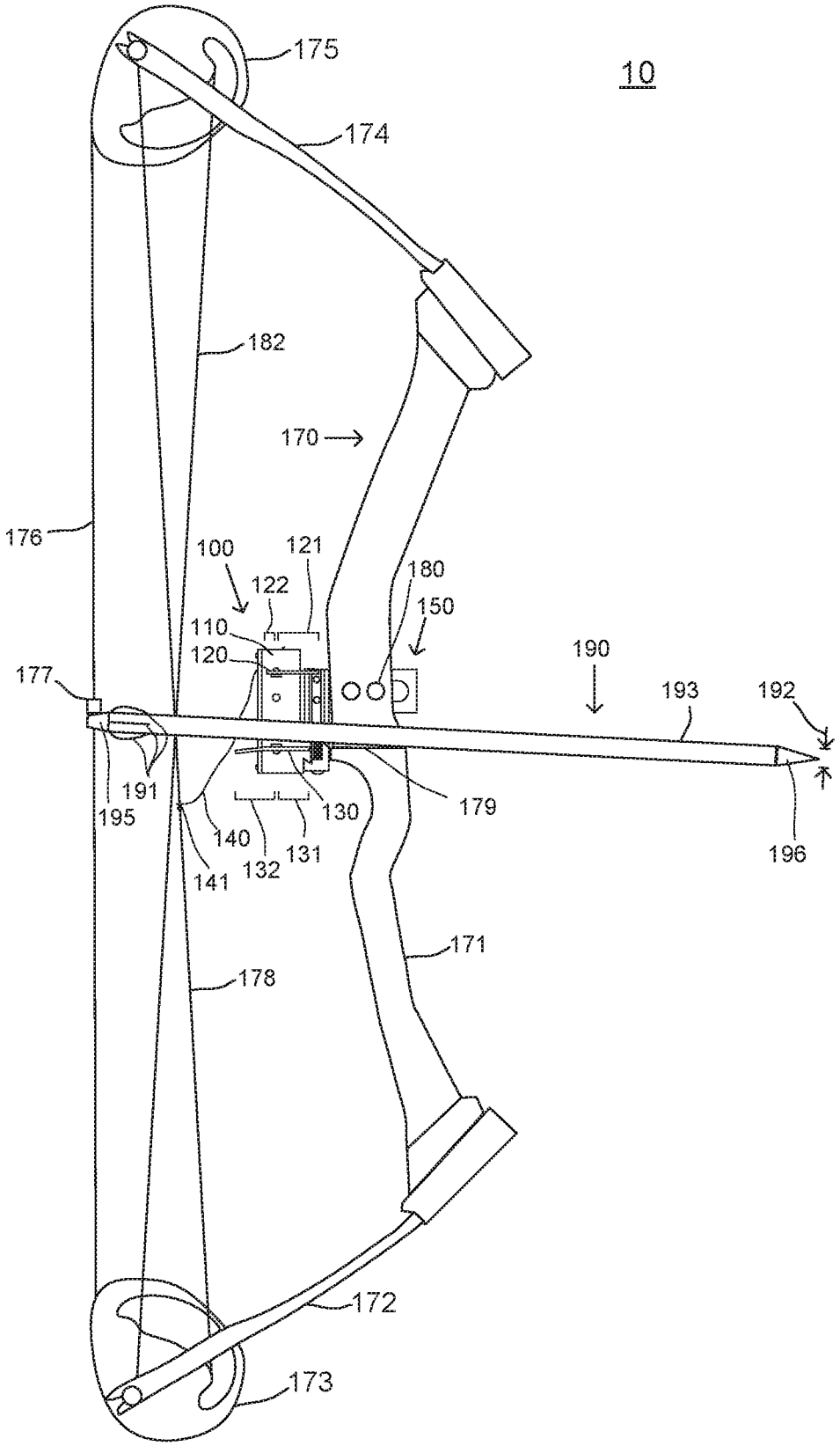
FIG. 1A illustrates a right side view of an archery system comprising an undrawn bow with an arrow rest coupled with the bow via an arrow rest mount where an arrow is nocked in the bow and the arrow rest is in a discharge configuration, in accordance with various aspects of the present disclosure.

Reference will now be made in detail to various embodiments of the subject matter, examples of which are illustrated in the accompanying drawings. While various embodiments are discussed herein, it will be understood that they are not intended to limit to these embodiments. On the contrary, the presented embodiments are intended to cover alternatives, modifications and equivalents, which may be included within the spirit and scope the various embodiments as defined by the appended claims. Furthermore, in this Description of Embodiments, numerous specific details are set forth in order to provide a thorough understanding of embodiments of the present subject matter. However, embodiments may be practiced without these specific details. In other instances, well known methods, procedures, components, and have not been described in detail as not to unnecessarily obscure aspects of the described embodiments.

Overview of Discussion

The arrow rest described herein has two configurations; an encapturing configuration and a discharge configuration. In the encapturing configuration, the two arms of the arrow rest rotate to create an aperture that encaptures the shaft of the arrow by surrounding all or nearly all of a circumference of the shaft of an arrow. The encapturing configuration has a detent position, or first stage, which holds the arrow in position and a second stage which still encaptures the arrow but moves the arms slightly from the detent position and holds the arrow a bit more loosely than the first stage. While an arrow is loaded the aperture and the arrow rest are in the first stage of the encapture configuration, the arrow may be nocked in the bow while in this first stage. The bow may then be drawn causing the arrow rest and aperture to move to the second stage. After being drawn, the string of the bow may be released slowly (i.e., "let down," without firing the arrow) allowing the arrow rest to move from the second stage back to the first stage. When moving from the second stage of the encapturing configuration back to the detent position of the first stage, the aperture will continue to encapture the shaft of the arrow to keep it in position and to prevent it from moving more than, typically, a few millimeters in any direction radially to the longitudinal axis of the shaft of the arrow. The close encapturing in this first stage of the encapturing configuration, diminishes rattling noise of an arrow shaft and makes it easy for the archer to handle the bow 170 with an arrow 190 loaded and ready to shoot. However, when the bow and then released to fire/loose the arrow, rather than being let down, the two arms of the arrow rest quickly rotate from the second stage of encapturing configuration to a discharge configuration which opens up the aperture so that the arrow can fly through the arrow rest. Typically, none of the fletching of an arrow will contact any portion of the arrow rest as the arrow takes flight from the bow.

Example Arrow Rest Coupled to a Bow Via an Arrow Rest Mount

FIG. 1A illustrates a right side view of an archery system 10 comprising an undrawn archery bow 170 with an arrow rest 100 coupled with the bow 170 via an arrow rest mount 150 where an arrow 190 is nocked in the bow 170 and the arrow rest 100 is in a discharge configuration, in accordance with various aspects of the present disclosure. It should be appreciated that bow 170 is left-handed. Arrow rest 100 is a left-handed version, a right handed version will operate identically, but will be a mirror image of the left-handed version. Arrow rest mount 150 is depicted in a left-handed configuration but can also be provided in a right-handed configuration that is a mirror image of the depicted left-handed configuration.

Bow 170 comprises a riser 171 which includes a shelf 179. An upper limb 174 is coupled to the upper portion of riser 171, and a lower limb 172 is coupled to the lower portion of riser 171. An upper cam 175 is coupled with upper limb 174 and a lower cam 173 is coupled with lower limb 172. A bow string 176 is strung between the upper limb 174 and lower limb 172 via cams 175 and 173 respectively and is depicted in an undrawn state. A first drive cable 178 is strung between opposing cam 173 and limb 174, while a second drive cable 182 is strung between opposing cam 175 and limb 172. A nock point 177 is located slightly above the center/midpoint of bow string 176, such that when nock 195 of arrow 190 is nocked below the nock point 177, then arrow 190 is positioned at or very near the center/midpoint of bow string 176. As depicted, riser 171 includes one or more threaded mounting holes, such as threaded mounting hole 180, to which accessories such as arrow rest mount 150 may be coupled, such as via a screw or bolt. Although bow 170 is a compound bow, it should be appreciated that the arrow rest 100 and arrow rest mount 150 may be utilized with other types of bows such as recurve bows.

Arrow rest mount 150 is coupled to bow 170 with a bolt (not visible) which passes through an opening of arrow rest mount 150 and into a threaded mounting hole such as hole 180. As will be further discussed, arrow rest mount 150 provides for three axes (e.g., x, y, and z in a cartesian 3-D coordinate system) adjustment relative to bow 170. Accordingly, any accessory, such as arrow rest 100, which is coupled with arrow rest mount 150 may also be adjusted in three dimensions with respect to bow 170.

Arrow 190, as depicted, has fletching 191 and a nock 195 near one end, and a point 196 (e.g., an arrowhead) at the opposing end. The shaft 193 of arrow 190 is round and has a circumference commensurate with its diameter 192. As depicted in FIG. 1A, arrow 190 is nocked and resting on shelf 179 at a downward sloping angle. The longitudinal axis of arrow 190 runs along arrow 190 from nock 195 to point 196.

Arrow rest 100 includes a body 110 with two arms (126, 136—shown in FIG. 1C) extending therefrom. Tab 120 is a part of the one of the arms (arm 126), while tab 130 is a part of the other of the arm (arm 136). Tab 120 has two portions, 121 and 122 that are located on opposite sides of its pivot axis on arm 126. Tab 130 has two portions 131 and 132 that are located on opposite sides of its pivot axis on arm 136. In the depicted embodiment, portion 132 is slightly angled and projects radially outward from shaft 135 in a different direction than portion 131. It should be appreciated that in some embodiments, tab 130 may be identical to a 180 degree rotated version of tab 120. Angled portion 132, when included, may be utilized as a thumb tab, such that a human operator may engage portion 132 with their thumb to rotate arms 126 and 136 from the discharge configuration to the encapturing configuration. Portion 132, which may be a thumb tab, extends radially outward from shaft 135 in a different radial direction than portion 131, and in some embodiments when angled with respect to portion 131 it also extends outward in a different plane than portion 131. The encapturing configuration of arrow rest 100 may also be referred to as a "load configuration," as an arrow may be loaded and held ready for firing when arrow rest 100 is so configured in the encapturing configuration. Tabs 120 and 130 are configured to rotate in concert with one another but in opposite directions of rotation from one another. As depicted, tabs 120 and 130 are rotated fully open in a discharge configuration of arrow rest 100. In the discharge configuration, portions (e.g., 121 and 131) of tabs 120 and 130 are parallel with or substantially parallel (e.g., plus or minus a few degrees) with one another and with shelf 179. In the discharge configuration an arrow can easily be inserted between the tabs and nocked into bow string 176. Any arrow previously encaptured when arrow rest 100 was in the encapturing configuration will be released from encapture when arrow rest 100 rotates arms 126 and 136 to the discharge configuration.

Though not required, as can be seen in FIG. 1A, the design of arrow rest 100 allows it to be adjustably positioned, via arrow rest mount 150, so that arrow rest 100 is fully behind shelf 179 (i.e., between shelf 179 and bow string 176). This position, behind shelf 179, permits use with a wider variety of arrow lengths than conventional arrow rests which are positioned above shelf 179. In some embodiments, arrows in the range of 20 inches to 34 inches (measured from nock to arrow head tip) may be utilized by a bow configured with arrow rest 100. This is because positioning arrow rest 100 behind shelf 179, places it closer to bow string 176 than a conventional arrow rest and facilitates an extended region of support for an arrow shaft that can be up to four inches greater than what is provided by a conventional arrow rest mounted above shelf 179. In some embodiments, arrow rest 100 can be adjustably positioned, such as via arrow rest mount 150, such that no portion of arms 126 and 136 are above shelf 179 during the encapturing configuration of arrow rest 100 or during both the encapturing and discharge configuration of arrow rest 100.

As one non-limiting example, when arrow rest 100 is positioned between shelf 179 and bow string 176, a shorter arrow can be nocked and drawn by a bow configured with arrow rest 100 that would otherwise be pulled or drawn out of a conventional arrow rest mounted above or have its arrow head impact the edge of a conventional arrow rest. This use of arrow rest 100 is similar to using an overdraw on a bow, except that it is safer because the shaft of the arrow is encaptured in arrow rest 100 in a manner that prevents it from slipping out and potentially falling onto or being fired into the hand which is gripping the bow (both of which can be risks when using an overdraw). Because a shorter arrow is lighter than an equivalent longer arrow, the shorter arrow can be shot faster, farther, and on a flatter trajectory when both are fired from the same bow.

Similarly, longer draw lengths are supported by arrow rest 100 being positioned behind shelf 179, as the positioning prevents an arrow head from impacting or being pulled out of arrow rest 100 as would happen with a conventional arrow rest positioned above shelf 179. By facilitating a longer draw length, arrow rest 100 also supports the use of longer arrows, should that be desired, and a wider array of arrow lengths than may be used in a conventional arrow rest that is positioned above shelf 179. For example, arrows of 20 inches in length or longer may be used, in some embodiments, of a bow 170 configured with arrow rest 100.

Body 110 of arrow rest 100 is attachable to an archery bow, such as bow 170. For example, mount 150 or means may be used to couple arrow rest 100 with an archer bow. Body 110 is coupled to drive cable 178 at connecting point 141 by a cord 140 which runs between connecting point 141 and a crank arm 145 (see FIG. 1B). In other embodiments, cord 140 may be similarly coupled with bow string 176. For example, in a recurve bow cord 140 may be coupled with the bow string since there are no drive cables to which it can be coupled. Pulling of cord 140 causes crank arm 145 to rotate, on its axis, toward bow string 176. For example, when cord 140 is attached to drive cable 178, bow string 176, or the like, movement of the connecting point 141 tightens cord 140 to a tightened state and pulls cord 140, thus rotating crank arm 145.

Figure 1B:
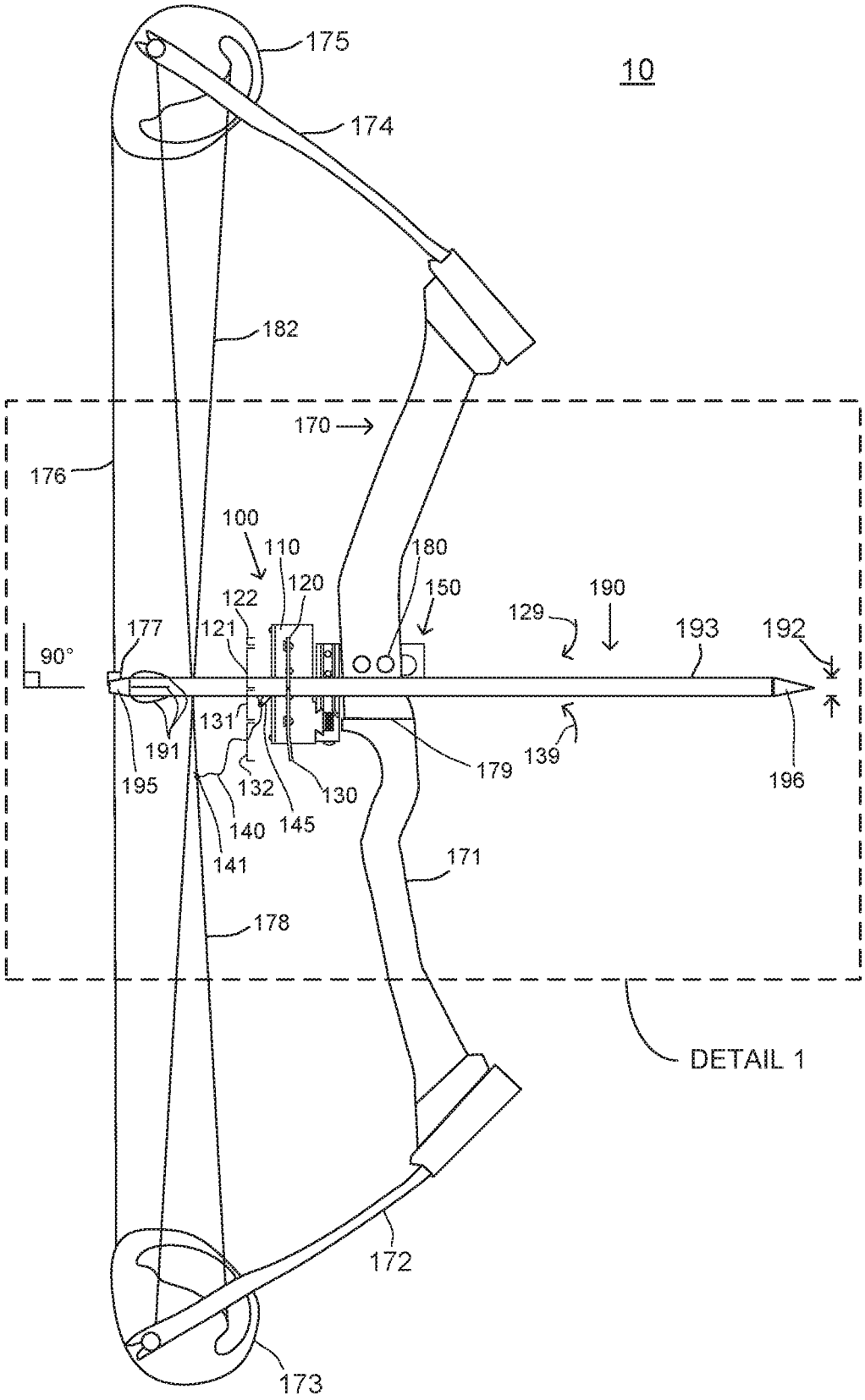
FIG. 1B illustrates a right side view of the archery system comprising the bow, arrow rest, and arrow rest mount of FIG. 1A with the bow undrawn, the arrow nocked, and the arrow rest in a first stage of an encapturing configuration, in accordance with various aspects of the present disclosure.

FIG. 1B illustrates a right side view of the archery system 10 comprising bow 170, arrow rest 100, and arrow rest mount 150 of FIG. 1A with the bow 170 undrawn, the arrow 190 nocked, and the arrow rest 100 in a first stage of an encapturing configuration, in accordance with various aspects of the present disclosure. This first stage of the encapturing configuration is associated with an arrow 190 being loaded in the arrow rest 100, and the bow 170 being either undrawn, or previously drawn and let down. It should be appreciated that this first stage of the encapturing configuration can also be without an arrow 190 being in the arrow rest 100. In the transition from the depiction in FIG. 1A to the depiction in FIG. 1B, crank arm 145 has been rotated downward and tabs 120 and 130 have pivoted with respect to body 110 to create an aperture (illustrated in FIG. 1C) which encaptures the circumference of arrow 190. Responsive to the movement from the discharge configuration to this first stage of the encapturing configuration a first portion (portion 122) of the first arm (e.g., arm 126 of FIG. 1C) and a first portion (portion 132) of the second arm (e.g., arm 136 of FIG. 1C) operate to move away from each other while a second portion (portion 121) of the first arm (e.g., arm 126 of FIG. 1C) and a second portion (portion 131) of the second arm (e.g., arm 136 of FIG. 1C) operate to move toward each other. In this manner, the distal edge of tab 120 in portion 121 and the distal edge of tab 130 in portion 131 operate to move away from each other when arm 126 and arm 136 rotatably move from the encapturing configuration of arrow rest 100 (illustrated in FIGS. 1A-1E) to the discharge configuration (illustrated in FIG. 1F and FIG. 1G). At the same time that these distal edges rotate away from each other, a portion of shaft 125 which is in portion 122 of arm 126 rotates toward a portion of shaft 135 which is in portion 132 of arm 136.

Figure 1C:
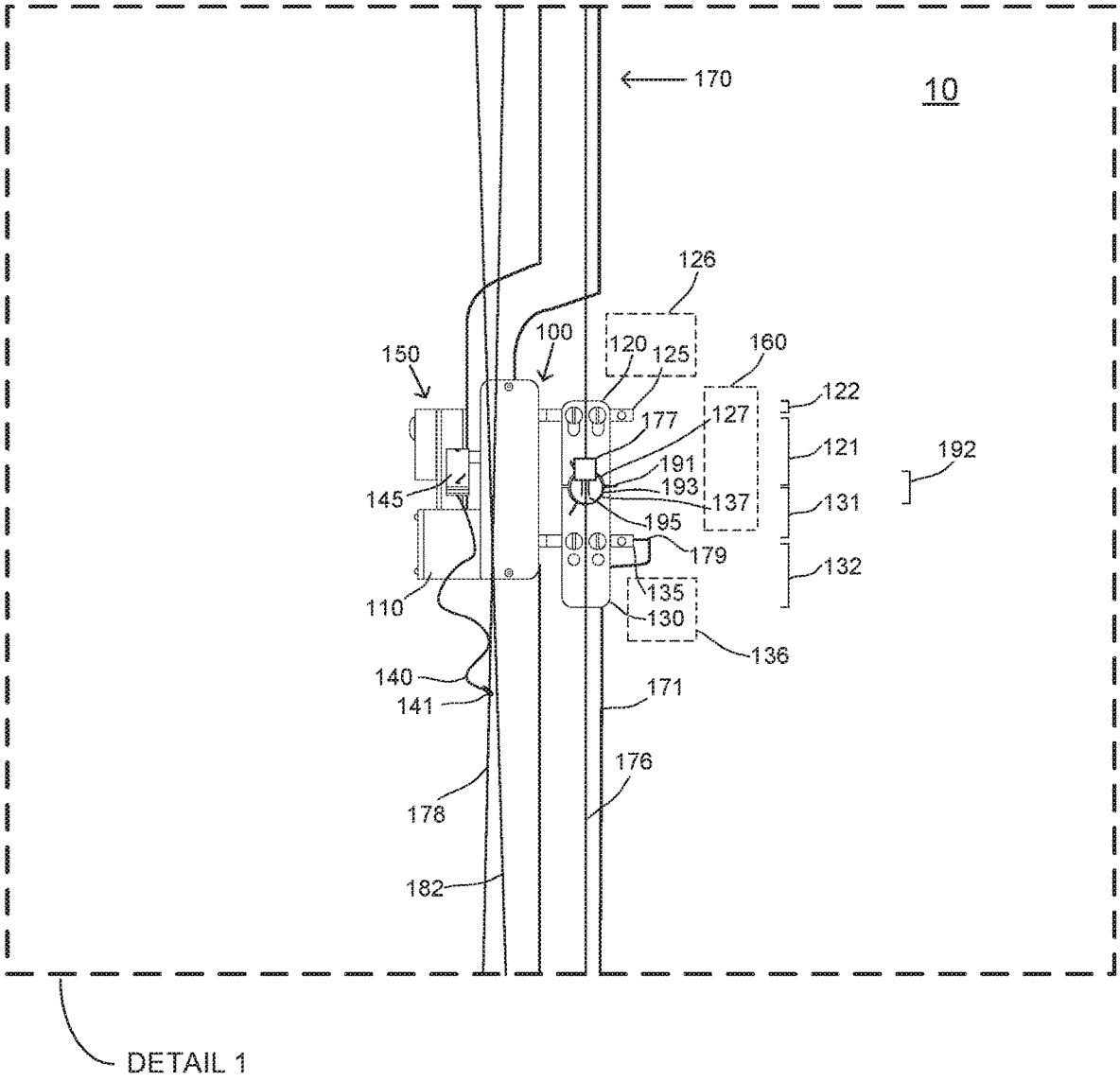
FIG. 1C illustrates a front detail view of FIG. 1B showing the bow, arrow rest, and arrow rest mount with the bow undrawn, the arrow nocked, and the arrow rest in the first stage of the encapturing configuration, in accordance with various aspects of the present disclosure.

The pivoting movement 129 of the first arm 126 and the pivoting movement 139 of the second arm 136, with respect to the depiction in FIG. 1A, may be achieved in a first way by manually rotating the crank arm 145 downward (with respect to the depiction in FIG. 1B and FIG. 1C). The pivoting 129, 139 may be achieved in a second way by manually rotating the second portion 132 of tab 130/arm 136 downward, such as with pressure from a thumb or finger. The pivoting 129, 139 may be achieved in a third way by pulling/drawing bow string 176, thus causing drive cable 178 and connecting point 141 to move downward and pull cord 140, and thus crank arm 145, downward. If bow string 176 has been drawn, slowly releasing the draw (also called "letting down") to the state depicted in FIG. 1B, leaves tabs 120 and 130 fixed in the illustrated encapturing configuration of arrow rest 100. As will be further described, this fixed state is enabled by a ball and detent arrangement located within body 110. The fixed state is only temporary as the holding power of the ball in the detent may be overcome manually by rotating crank arm 145 or either of tabs 120/130 or automatically by firing the bow instead of slowly releasing the bow string. Additionally, as a safety feature of arrow rest 100, impact of the fletching of an arrow into tab 120 and/or tab 130 will overcome the holding power of the ball in the detent and trigger opening of arms 126 and 136 to the discharge configuration if the automatic opening fails to occur during firing of a bow.

FIG. 1C illustrates a front detail view (front view of Detail 1) of FIG. 1B showing the bow 170, arrow rest 100, and arrow rest mount 150 with the bow 170 undrawn, the arrow 190 nocked, and the arrow rest 100 in the first stage of the encapturing configuration, in accordance with various aspects of the present disclosure. Arm 126 is movably mounted with respect to body 110 and comprises shaft 125 and tab 120. More particularly, arm 126 rotates about a longitudinal axis of shaft 125. As can be seen in FIG. 1B and FIG. 1C the longitudinal axis of shaft 125 is orthogonal to the longitudinal axis of arrow 190 while arrow 190 is resting in arrow rest 100. During pivot/rotation of shaft 125, the longitudinal axis of shaft 125 maintains a fixed relationship with body 110. Tab 120 extends outward from shaft 125. In some embodiments, tab 120 extends radially outward from shaft 125, which may be hemicylindrical at the locations which couple to tab 120. Arm 136 is movably mounted with respect to body 110 and comprises shaft 135 and tab 130. More particularly, arm 136 rotates about a longitudinal axis of shaft 135. As can be seen in FIG. 1B and FIG. 1C the longitudinal axis of shaft 135 is orthogonal to the longitudinal axis of arrow 190 (while arrow 190 rests in arrow rest 100) while also being parallel to the longitudinal axis of shaft 125. During pivot/rotation of shaft 135, the longitudinal axis of shaft 135 maintains a fixed relationship with body 110 and with the longitudinal axis of shaft 125. By "fixed relationship" what is meant is that the angle between the first longitudinal axis and the second longitudinal axis does not change, nor does an angle between body 110 and the longitudinal axis of either of shaft 125 and shaft 135. Tab 130 extends outward from shaft 135. In some embodiments, tab 130 extends radially outward from shaft 135, which may be hemicylindrical at the locations which couple to tab 130.

In the depicted embodiment, a recess 127 in a distal edge of tab 120 and a recess 137 in the distal edge of tab 130 operate together to form an aperture 160 which surrounds or substantially surrounds the circumference of the shaft 193 of arrow 190; wherein tab 120 of arm 126 captures a first segment of the circumference of the shaft 193 and tab 130 of arm 136 captures a second segment of the circumference of shaft 193. In some embodiments, "substantially surrounds" means that 75% or greater of circumference of the shaft of arrow 190 is surrounded. In some embodiments, "substantially surrounds" means that 50% or greater of circumference of the shaft of arrow 190 is surrounded. In some embodiments, "substantially surrounds" means that enough of the circumference of the shaft of arrow 190 is surrounded that it is not possible for the arrow to slip radially out of any gap that may exist between tab 120 and tab 130. This surrounding/substantial surrounding encaptures the circumference of arrow 190. For example, in some embodiments, the encapturing configuration allows and permits movement of arrow 190 in a direction along a longitudinal axis of the shaft 193 of the arrow and resists movement of the arrow in any direction orthogonally radial to the longitudinal axis of the shaft 193 of arrow 190. That is, when "encaptured," the resisting of movement may mean that shaft 193 may be either prevented from moving radially in some directions or may only be able to move a small distance (e.g., a few millimeters) before the edges of a recess (127, 137) come into contact with the shaft 193, resist further radial movement, and prevent the escape of shaft 193 from aperture 160. In general, the amount of radial movement permitted of an encaptured arrow is based on a relationship between the size of aperture 160 the circumference of the arrow. In practice, selection of a combination of tabs (such as tabs 120 and 130) and an arrow can either prevent or limit the radial movement of the shaft of an encaptured arrow 190 in directions radial to the longitudinal axis of the shaft of the arrow 190.

With respect to such a gap in an aperture 160, in some embodiments, tabs 120 and 130 may be adjustably positioned with respect to shafts 125 and 135 such that they meet or touch one another when in the first stage of the encapturing configuration, thus leaving no gap. In such a configuration, the circumference of the shaft of arrow 190 will be fully encompassed by aperture 160. In other embodiments, the tabs may be positioned such that there is a small gap (e.g., up to 5 mm in some embodiments) between the closest portions of tabs 120 and 130 when tabs 120 and 130 are in the first stage of the encompassing configuration. It should be noted that any stage (first, second, or in between) of the encapturing configuration encaptures and contains the shaft 193 of arrow 190 such that it cannot radially escape from aperture 160; meaning that any gap between the most distal regions of tabs 120 and 130 from their points of attachment to their respective shafts 125, 135 will be less than diameter 192. When in the encompassing configuration some portion of recess 127 and/or recess 137 may contact the shaft of arrow 190. For example, edges of recess 127 and/or recess 137 may support and/or engage with shaft 193 of arrow 190 while the tail section (i.e., nock 195) of arrow 190 engages with (e.g., is nocked in) bow string 176 for shooting of arrow 190.

As is illustrated by FIGS. 1B and 1C, in some embodiments, arrow rest 100 is adjustably positionable such that a center point (see e.g., 399 of FIG. 3A) of the aperture 160 forms a right angle with bow string 176, where a vertex of the right angle is at or nearly at a midpoint of bow string 176 (the location where nock 195 of arrow 190 engages bow string 176) when the bow is in an undrawn/unpulled state. In operation, upper tab 120 and lower tab 130 can be adjusted such that they touch or nearly touch when arrow rest 100 is in the first stage of the encapturing configuration as illustrated in FIG. 1B and FIG. 1C thus forming an aperture 160 from recess 127 and recess 137 which fully encompasses and fully radially contains shaft 193 of an arrow. Even when upper tab 120 and lower tab 130 do not touch each other in the position illustrated in FIG. 1B and FIG. 1C, shaft 193 of arrow 190 is still radially contained and cannot move laterally (in any direction radial to the longitudinal axis of arrow 190) out of the aperture 160 formed by recess 127 and recess 137. The adjustability of upper tab 120 and lower tab 130 in an up/down direction relative to FIG. 1B and FIG. 1C permits radial containment of a variety of shaft sizes. For example, in one embodiment arrow rest 100 can be adjusted such that aperture 160 may fully encompass or else radially contain/encapture arrows 190 with shaft 193 diameters up to 27/64 inches. In some embodiments, arrow rest 100 may be configured to capture arrow shafts 193 in the range of 0.166 inches in diameter to 0.421 (i.e., 27/64) inches in diameter.

Figure 1D:
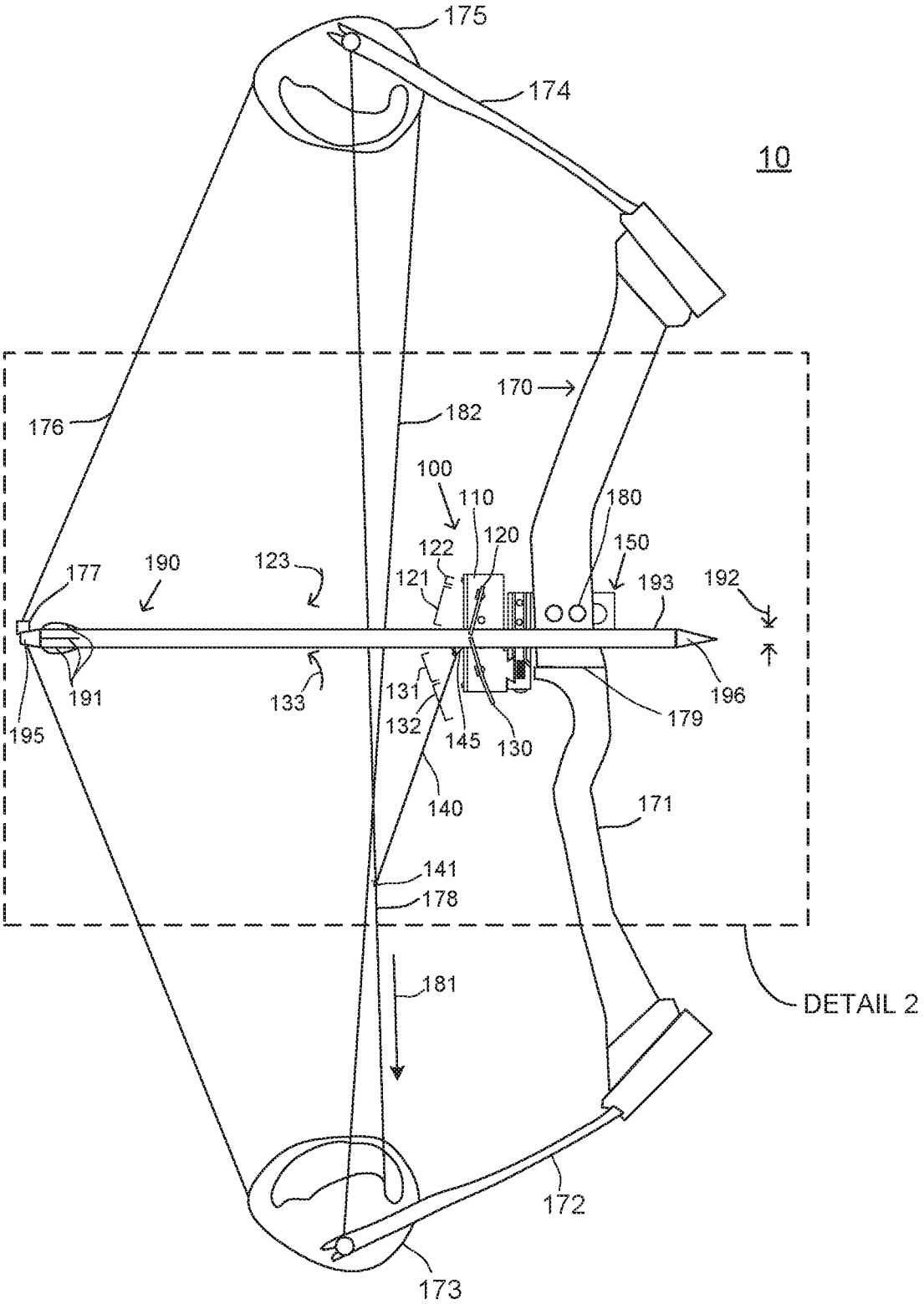
FIG. 1D illustrates a right side view of the archery system comprising the bow, arrow rest, and arrow rest mount of FIG. 1A with the bow drawn, the arrow nocked, and the arrow rest in a second stage of the encapturing configuration, in accordance with various aspects of the present disclosure.

FIG. 1D illustrates a right side view of the archery system 10 comprising bow 170, arrow rest 100, and arrow rest mount 150 of FIG. 1A with the bow 170 drawn, the arrow 190 nocked, and the arrow rest 100 in a second stage of the encapturing configuration, in accordance with various aspects of the present disclosure. This second stage of the encapturing configuration is associated with an arrow 190 being loaded in the arrow rest 100, and the bow 170 being drawn. It should be appreciated that this second stage of the encapturing configuration can also be achieved without an arrow 190 being in arrow rest 100. Upon drawing of bow string 176, drive cable 178 and connecting point 141 have moved downward in direction 181 pulling cord 140 tight and rotating crank arm 145 downward with respect to body 110. The downward rotation of crank arm 145 causes tab 120 to rotate 123 slightly from the position illustrated in FIG. 1B and causes tab 130 to rotate 133 slightly from the position illustrated in FIG. 1B.

Figure 1E:
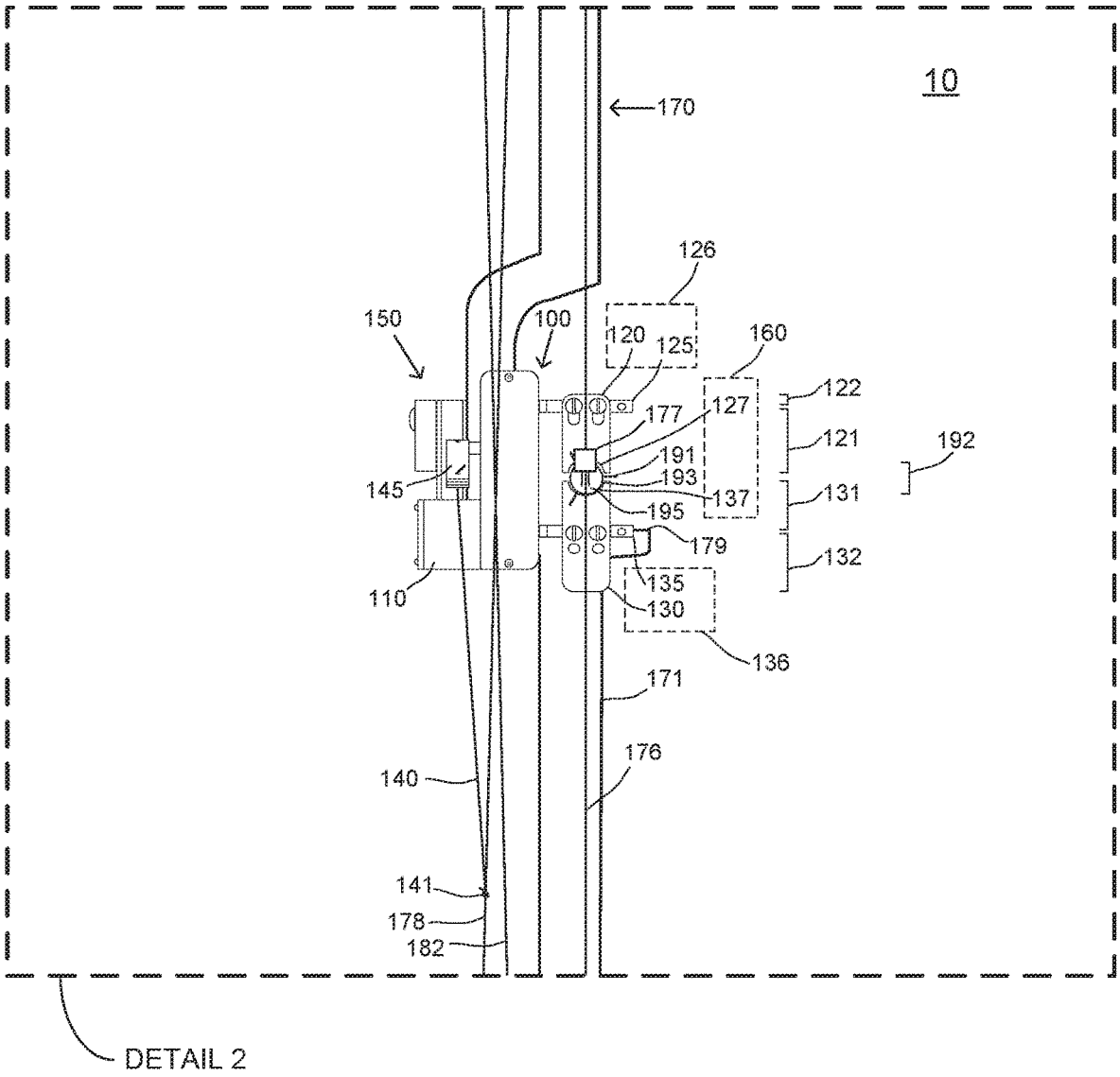
FIG. 1E illustrates a front detail view of FIG. 1D showing the bow, arrow rest, and arrow rest mount with the bow drawn, the arrow nocked, and the arrow rest in the second stage of the encapturing configuration, in accordance with various aspects of the present disclosure.

FIG. 1E illustrates a front detail view (front view of Detail 2) of FIG. 1D showing the bow 170, arrow rest 100, and arrow rest mount 150 with the bow 170 drawn, the arrow 190 nocked, and the arrow rest 100 in the second stage of the encapturing configuration, in accordance with various aspects of the present disclosure. As illustrated in FIG. 1E stage two of the encapturing configuration slightly opens aperture 160 as compared to its size in FIG. 1C, but the aperture still encaptures the shaft of arrow 190 and limits movement radially to the longitudinal axis of arrow 190. Although not depicted as such in the Figures, in some embodiments, crank arm 145 may be adjusted laterally (left/right with respect to FIG. 1E) in position with respect to riser 171 and/or arrow rest 100 may be adjusted laterally in position with respect to riser 171 such that a portion of crank arm 145 rotates in a plane that is coplanar or nearly coplanar (within 10 degrees of being coplanar) with drive cable 178 and tightened cord 140. When crank arm 145 is so positioned this reduces or eliminates sideways pull of cord 140 on connecting point 141, thus reducing/eliminating sideways friction forces on drive cable 178 that might be caused by tensioning of cord 140 when bow string 176 is drawn. This reduction of and/or elimination of sideways pull on drive cable 178 by cord 140 reduces cable pressure which permits increased speed of bow string 176 (and thus increased arrow release speed) as compared to a conventional cable driven arrow rest. The reduction of and/or elimination of sideways pull on drive cable 178 by cord 140 also reduces wear on drive cable 178, reduces wear on bow string 176, and reduces wear on rotating components such as cams 173 and 175 as compared to a conventional cable driven arrow rest.

Figure 1F:
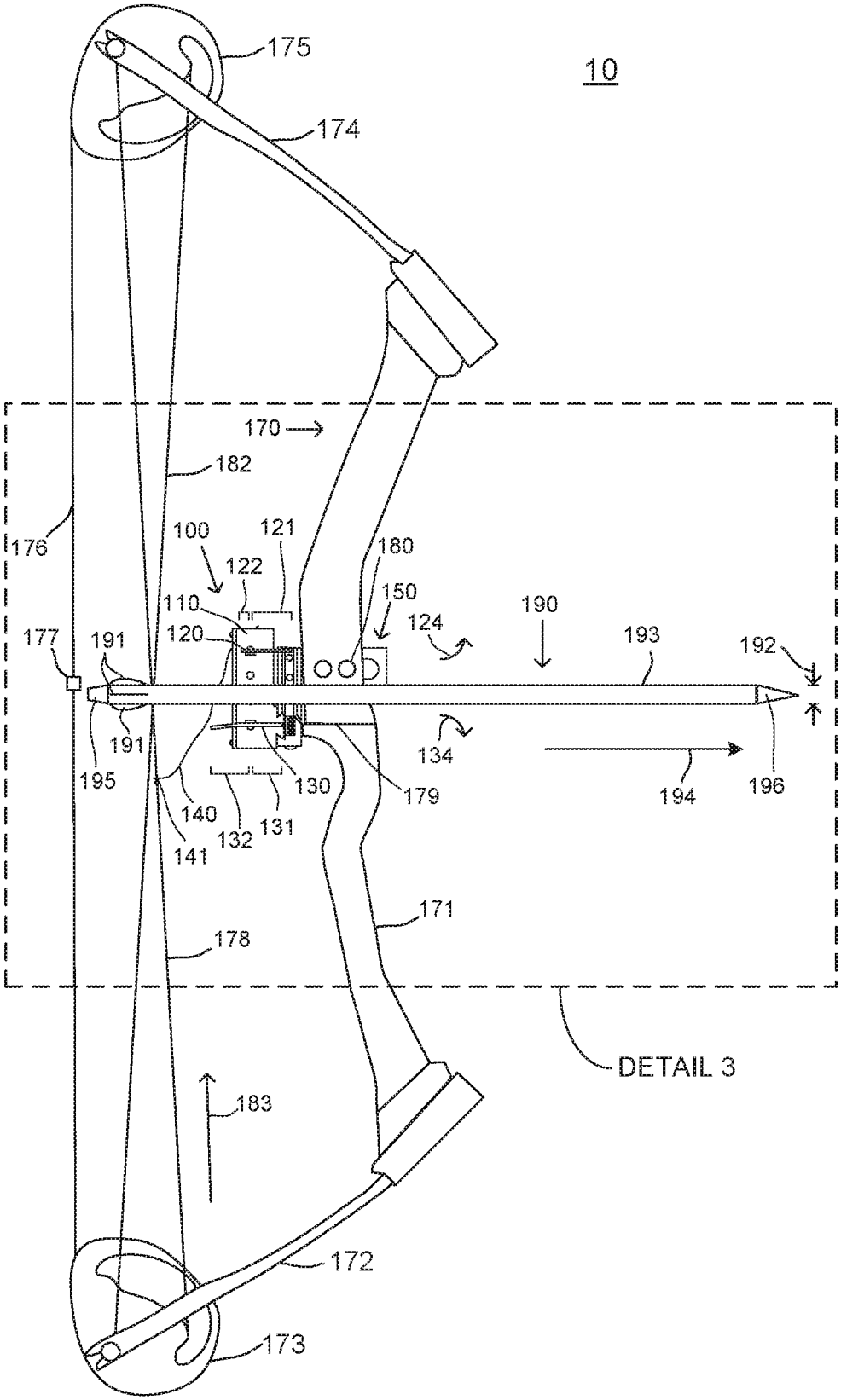
FIG. 1F illustrates a right side view of the archery system comprising the bow, arrow rest, and arrow rest mount of FIG. 1A with the bow string of the bow released, the arrow in flight, and the arrow rest in the discharge configuration, in accordance with various aspects of the present disclosure.

FIG. 1F illustrates a right side view of the archery system 10 comprising bow 170, arrow rest 100, and arrow rest mount 150 of FIG. 1A with the bow string 176 of the bow released (to discharge arrow 190), the arrow 190 in flight in direction 194, and the arrow rest 100 in the discharge configuration, in accordance with various aspects of the present disclosure. This discharge configuration is associated with an arrow 190 being fired/released when bow 170 has been released/fired. It should be appreciated that this release configuration can also be achieved, without an arrow 190 being fired from the bow. Upon release of bow string 176, drive cable 178 and connecting point 141 have upward in direction 183, opposite of direction 181, quickly releasing cord 140 and allowing crank arm 145 to rotate upward with respect to body 110. This upward rotation of crank arm 145 is due to a biasing urge which will be described later, and which triggers this upward rotation upon the release of bow string 176. Crank arm 145 rotates in a plane that is parallel with the plane in which bow string 176 is pulled. The upward rotation of crank arm 145 and the rotation of components coupled thereto causes tab 120 to rotate 124 from the position illustrated in FIG. 1D until the position illustrated in FIG. 1F is achieved. Likewise, the upward rotation of crank arm 145 and the rotation of components coupled thereto simultaneously causes tab 130 to rotate 134 from the position illustrated in FIG. 1D until the position illustrated in FIG. 1F is achieved. During this movement from the encapturing configuration to the discharge configuration a first portion 121 (which includes a distal edge of tab 120) of the first arm 126 and a first portion 131 (which includes a distal edge of tab 130) of the second arm 136 operate to move away from each other when their starting and ending positions are compared, while a second portion 122 of the first arm 126 and a second portion 132 of the second arm 136 operate to move toward each other when their starting and ending positions are compared.

It should be appreciated that, upon the firing of bow string 176, movement of arrow rest 100 from the encapturing configuration to the discharge configuration triggered. In response to this triggering, tabs 120 and 130 and their respective arms 126 and 136 rotate 124, 134 very quickly from their starting positions in the second stage of the encapturing configuration (illustrated in FIG. 1D and FIG. 1E) through the first stage of the encapturing configuration (illustrated in FIG. 1B and FIG. 1C) until ending at the discharge configuration (illustrated in FIG. 1F and FIG. 1G). Thus, even though portions 121 and 131 are farther apart when starting and ending positions are viewed, in the course of moving between the second stage of the encapturing configuration to the discharge configuration portions 121 and 131 actually operate to move toward each other (i.e., closer together) before moving away from each other to achieve the discharge configuration. In operation, the rotation 124, 134 of tabs 120 and 130, upon a firing release of bow string 176, occurs so quickly that it is completed before fletching 191 passes between tabs 120 and 130.

When an arrow is fired/loosed from a bow, it is accelerated over a short period of time (typically less than 15 ms in a compound bow) by force stored in the bow and the drawn bow string being transmitted into the arrow. This acceleration compresses the arrow with an axial load. This axial load and other forces cause the arrow to buckle, flex, and begin one or more oscillations which will typically damp out over the flight of the arrow. To improve accuracy and predictability of shots, bows are typically tuned to be fired with an arrow shaft of a particular length (e.g., 29 inches) and a particular amount of stiffness so that these oscillation(s) remain consistent arrow to arrow and shot to shot. Stiffness of the shaft of an arrow shaft is typically specified in a measurement called "spine," where a higher spine number is associated with a more flexible arrow and a lower spine number is associated with a stiffer arrow. In general, other things such as length and material of construction being held equal, a stiffer (lower spine) arrow shaft is heavier than a more flexible (higher spine) arrow shaft. Using stiffer spines is one conventional way to control oscillation as draw weight of bow increases and/or arrow shaft length decreases or else to decrease oscillation magnitude while maintaining other factors constant.

As previously discussed, arrow rest 100 rotates arms 126 and 136 from the second stage of the encapturing configuration through the first stage of the encapturing configuration on the way to the discharge configuration when bow string 176 is released and arrow 190 is fired/loosed from bow 170. As the arrow 190 travels in direction 194 it remains encaptured for a short period of this movement and may even come into contact with portions of tabs 120 and 130 which form aperture 160. The increased restriction of movement imposed by aperture 160 for several milliseconds after the loosing of the arrow 190 (because aperture defining portions of tabs 120 and 130 move closer together before moving apart), dampens flexing and oscillation of the shaft 193 of arrow 190 as it moves through arrow rest 100. Because of the restriction of oscillation, when compared with conventional arrow rests, arrow rest 100 facilitates the use of a variety of arrow lengths and spine stiffnesses without retuning bow 170. Because arrow rest 100 may be adjustably positioned between shelf 179 and bow string 176, arrow rest facilitates thus facilitates use of shorter arrow shafts, as compared to conventional arrow rests. This dampening action means that if an archer center shot tunes a bow 170 for particular shaft length/spine combination, arrow rest 100 will allow the bow 170 to operate as if it has been center shot tuned for a variety of shaft lengths/spine combinations without requiring re-tuning. This means that arrows utilized with arrow rest 100 can be lighter due to being shorter, lighter due to having higher spine, or both. In either or both of these manners, when compared with conventional arrow rests, arrow rest 100 allows a bow to shoot lighter arrows which fly faster, farther, and on a flatter trajectory. Even when the same arrow length/spine is used, the dampening action of arrow rest 100 improves accuracy as compared to shooting the arrow with a conventional arrow rest.

Figure 1G:
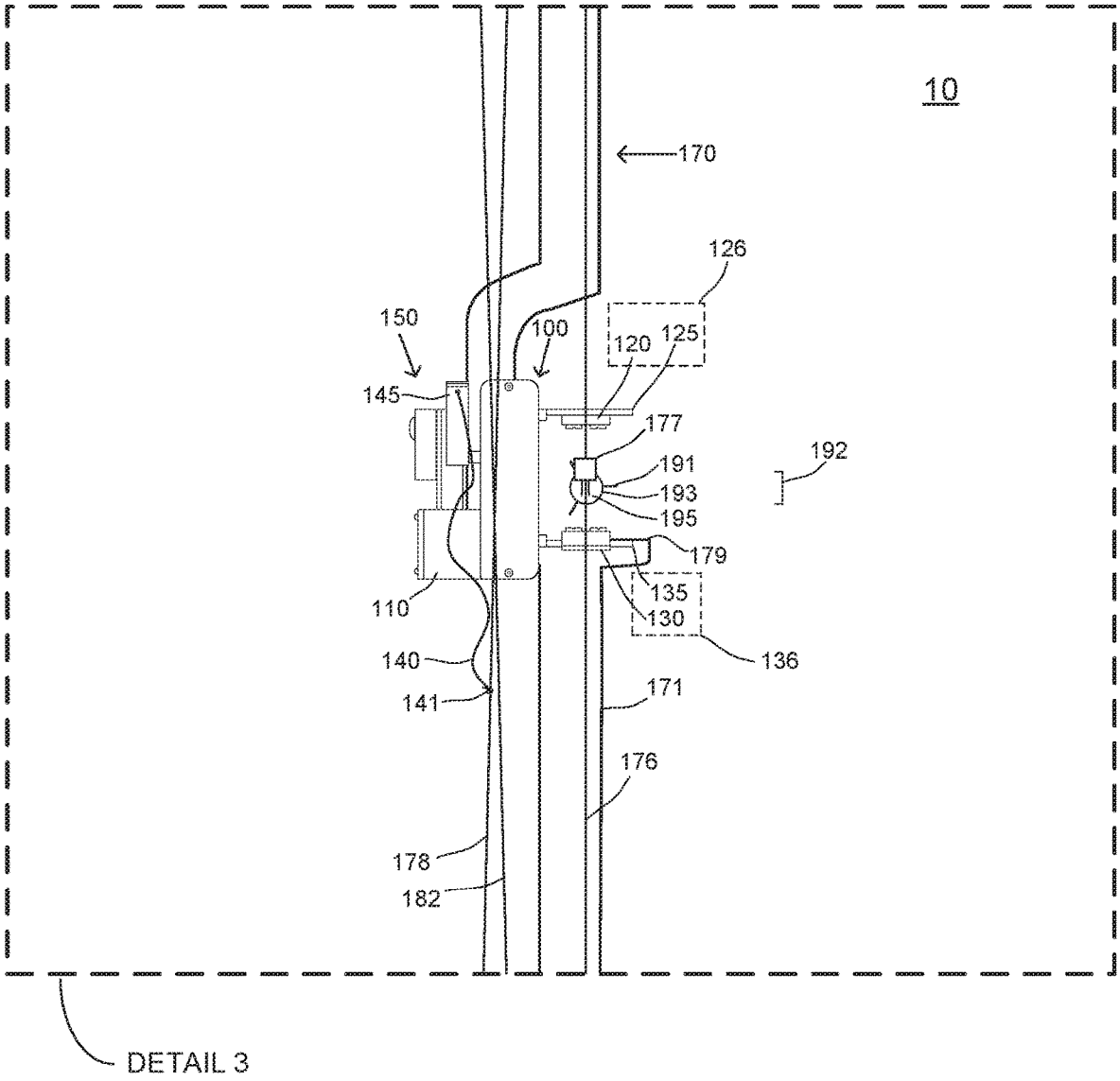
FIG. 1G illustrates a front detail view of FIG. 1F showing the bow, arrow rest, and arrow rest mount with the bow string of the bow released, the arrow in flight, and the arrow rest in the discharge configuration, in accordance with various aspects of the present disclosure.

FIG. 1G illustrates a front detail view (front view of Detail 3) of FIG. 1F showing the bow 170, arrow rest 100, and arrow rest mount 150 with the bow string 176 of the bow 170 released, the arrow 190 in flight, and the arrow rest 100 in the discharge configuration, in accordance with various aspects of the present disclosure. As can be seen tabs 120 and 130 rotate completely out of the discharge and flight path of arrow 190, in one embodiment, and no portion of the fletching 191 (and the like) touches any portion of arrow rest 100 as arrow 190 flies through arrow rest 100.

In operation, upper tab 120 and/or lower tab 130 can be adjusted such that they provide clearance for most fletching setups typically used. For example, in some embodiments, tab 120 and tab 130 can be adjusted such that arrow rest 100 provides a 1.4 inch gap for fletching clearance, which will provide clearance for a typical three vane fletching when the arrow is shot in an odd-vane-out orientation. Additionally, adjustments to upper tab 120 and/or lower tab 130 facilitate x-axis and y-axis positioning (with respect to FIGS. 1C and 1E) of aperture 160 in addition to the x-axis, y-axis, and z-axis (with respect to FIGS. 1C and 1E) positioning of arrow rest 100 provided by arrow rest mount 150.

Example Arrow Rest Coupled with Arrow Rest Mount

Figure 2D:
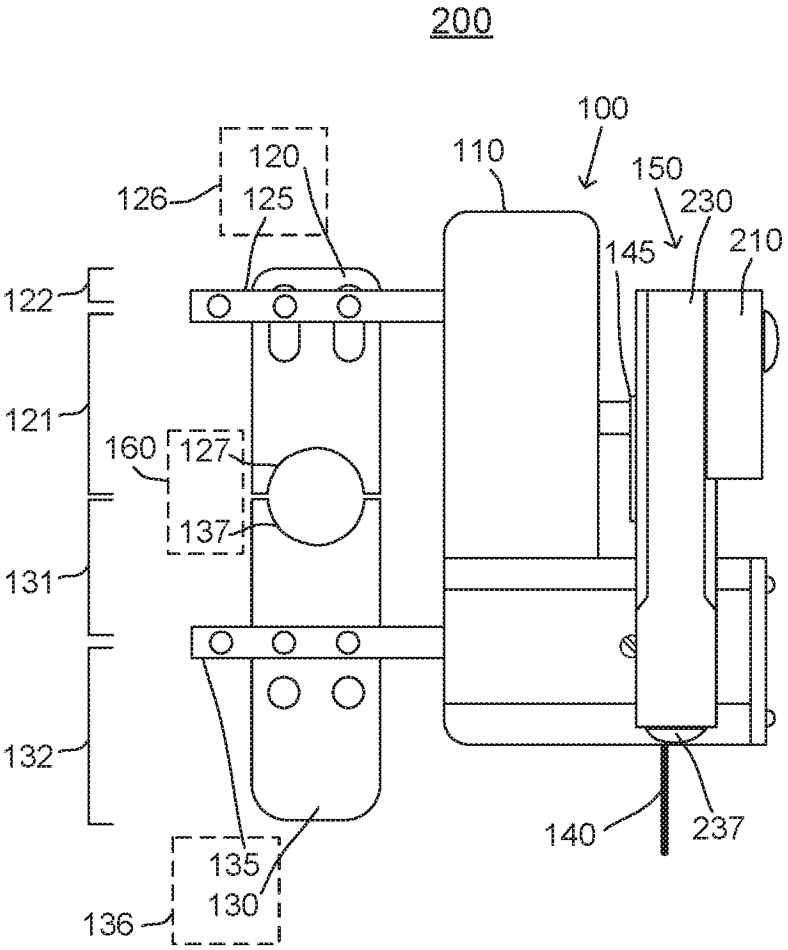
FIG. 2D illustrates a rear view of the assembly of FIG. 2A of an arrow rest coupled with an arrow rest mount, in accordance with various aspects of the present disclosure.
Figure 2A:
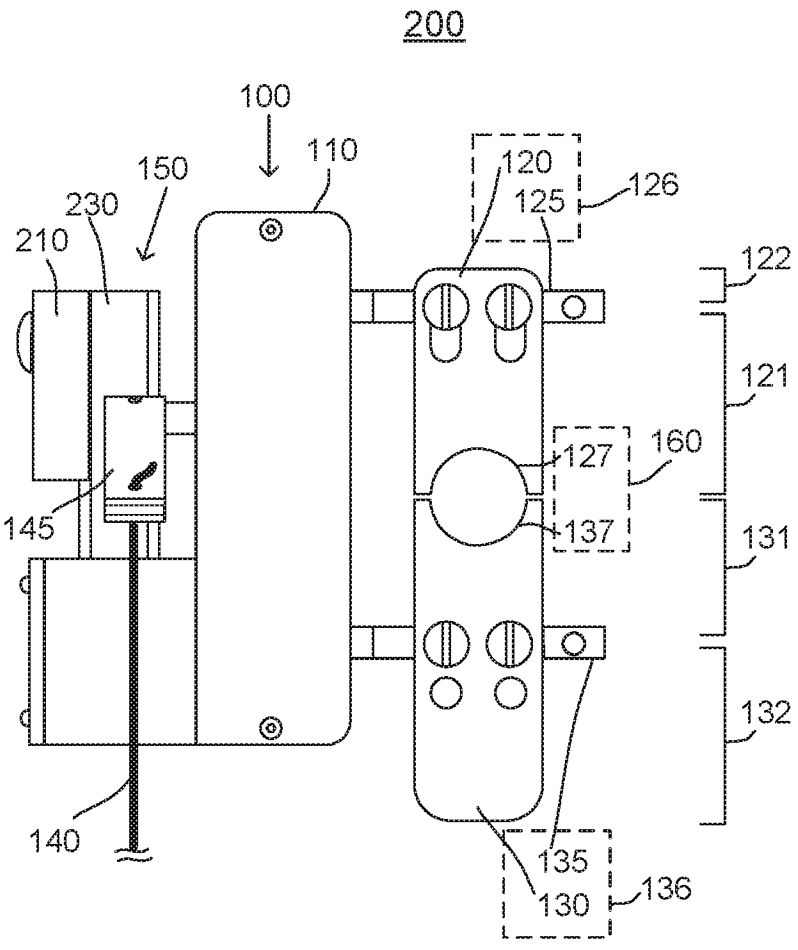
FIG. 2A illustrates a front view of an assembly of an arrow rest coupled with an arrow rest mount, in accordance with various aspects of the present disclosure.

FIG. 2A illustrates a front view of an assembly 200 which comprises an arrow rest 100 coupled with an arrow rest mount 150, in accordance with various aspects of the present disclosure. As in FIG. 1B, FIG. 1C arms 126 and 136 are shown rotated to the first stage of the encapturing configuration. It should be appreciated that, overall, the encapturing configuration (first stage and/or second stage) is a load position of arrow rest 100 in which an arrow, such as arrow 190, may be loaded and held in position for firing from a bow. This holding of the arrow can be loose or firm depending upon how tabs 120 and/or 130 are adjusted and the size of aperture 160 in relation to the diameter of the shaft 193 of an encaptured arrow 190.

Arrow rest mount 150 operates to couple the body 110 of arrow rest 100 with a bow, such as bow 170. For example, in one embodiment, arrow rest mount 150 couples the body 110 of arrow rest 100 with the riser of a bow. Arrow rest mount 150 comprises a first limb 210 and a second limb 230. First limb 210 may be bolted or screwed or otherwise removably coupled to a bow (e.g., to holes such as threaded hole 180 in bow 170). First limb 210 provides fore and aft adjustable positioning of assembly 200 with respect to the bow (with respect to FIG. 2A it would provide adjustment on a z-axis in and out of the page) and also permits adjusting up and down adjustment with respect to limb 230 (e.g., up/down or on a y-axis with respect to FIG. 2A). Limb 230 is configured to couple with arrow rest 100 and provide left right adjustment of arrow rest 100 with respect to arrow rest mount 150 (e.g., left/right or on an x-axis with respect to FIG. 2A).

Figure 2B:
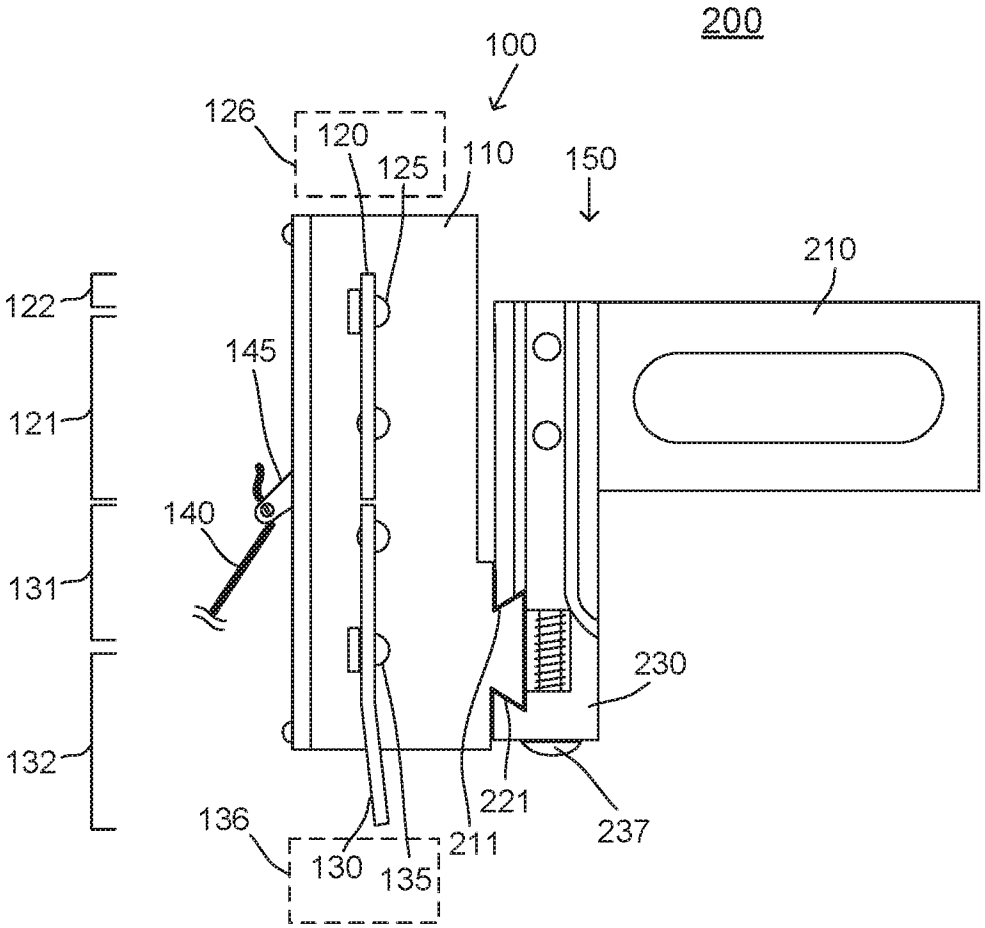
FIG. 2B illustrates a right side view of an assembly of FIG. 2A of an arrow rest coupled with an arrow rest mount, in accordance with various aspects of the present disclosure.

FIG. 2B illustrates a right side view of the assembly 200 of arrow rest 100 coupled with arrow rest mount 150, in accordance with various aspects of the present disclosure. FIG. 2B illustrates the sliding dovetail joint formed by rail/tail 211 of arrow rest 100 and socket 221 of limb 230 of arrow rest mount 150. This sliding dovetail joint facilitates the left right adjustment discussed with respect to FIG. 2A. A screw 237 which spans socket 221 (see FIG. 15A) may be tightened to compress socket 221 onto rail/tail 211 to removably fix the relationship of arrow rest 100 and arrow rest mount 150 in a desired location/arrangement.

Although the depicted embodiments in FIG. 2B and elsewhere, illustrate arrow rest 100 with a rail/tail 211 for interfacing with a socket 221 of arrow rest mount 150, some embodiments of arrow rest 100 additionally or alternatively include other features such as clamps, holes, screws, and the like for fixedly and/or removably coupling arrow rest 100 with either a bow or a mount that interfaces between arrow rest 100 and a bow.

Figure 2C:
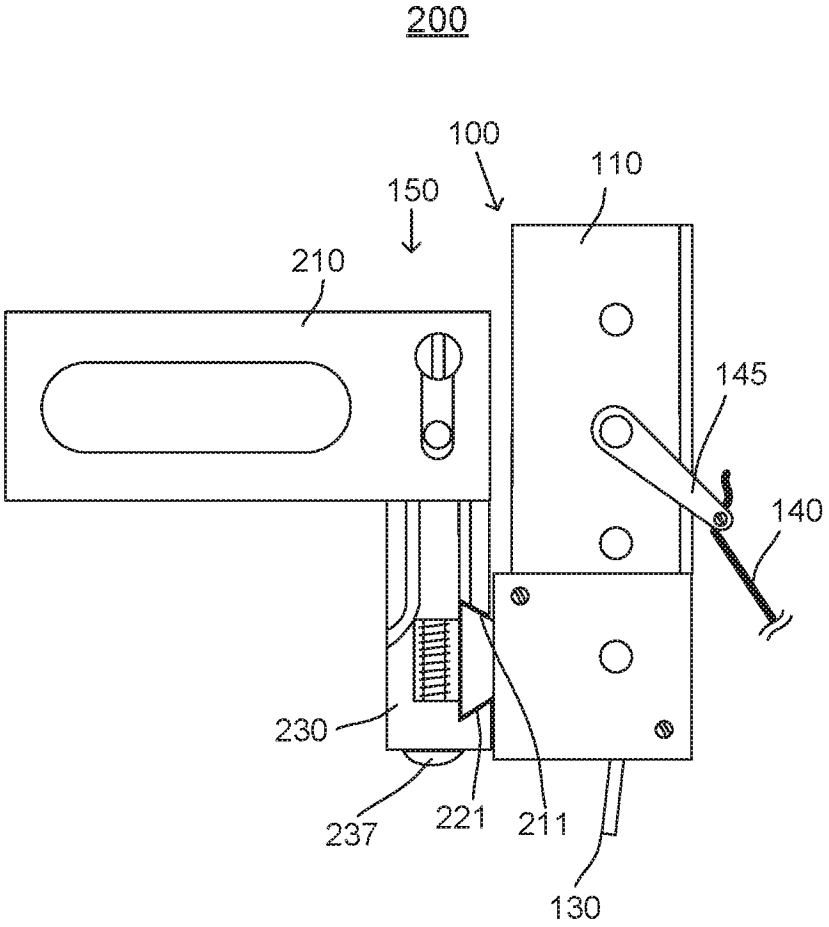
FIG. 2C illustrates a left side view of the assembly of FIG. 2A of an arrow rest coupled with an arrow rest mount, in accordance with various aspects of the present disclosure.

FIG. 2C illustrates a left side view of the assembly 200 of arrow rest 100 coupled with arrow rest mount 150, in accordance with various aspects of the present disclosure.

FIG. 2D illustrates a rear view of the assembly 200 of arrow rest 100 coupled with arrow rest mount 150, in accordance with various aspects of the present disclosure.

Example Arrow Rest

Figure 3A:
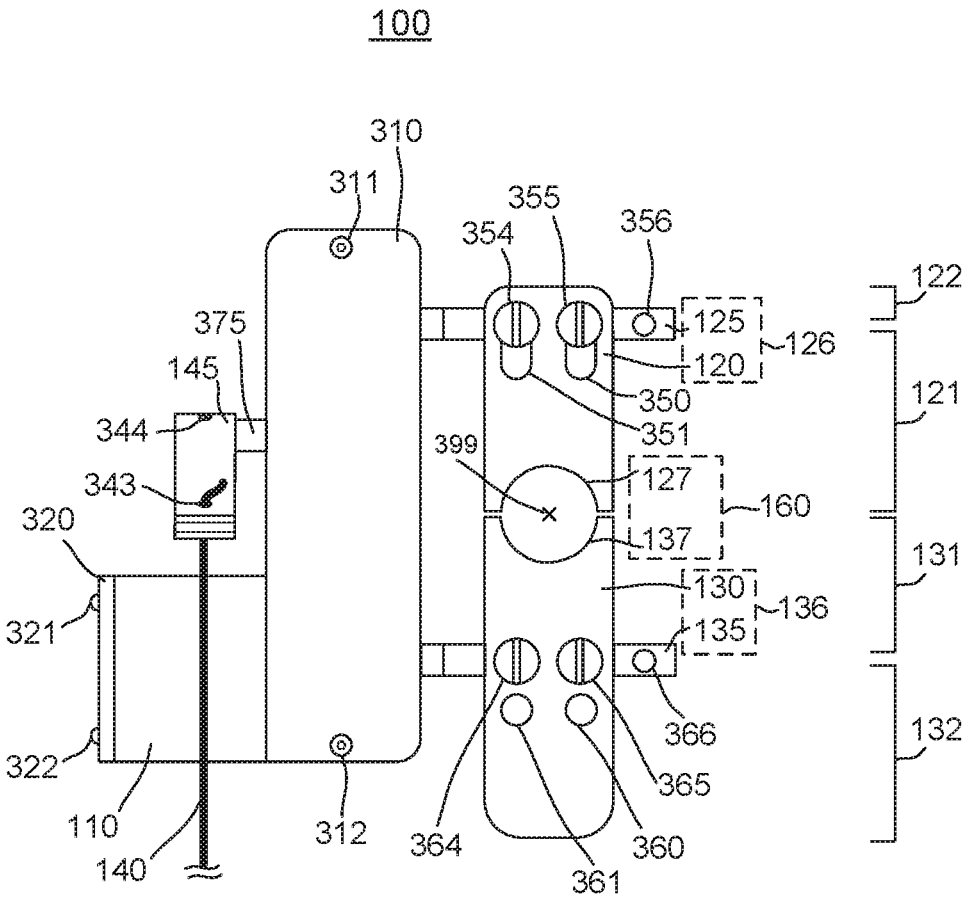
FIG. 3A shows a front view of an arrow rest, in accordance with various aspects of the present disclosure.

FIG. 3A shows a front view of an arrow rest 100, in accordance with various aspects of the present disclosure. This is the same arrow rest 100 previously depicted in FIGS. 1A-2D, but it is now depicted alone so that parts of arrow rest 100 can be more easily discerned. As in FIG. 1B, FIG. 1C, and FIGS. 2A-2D, arms 126 and 136 are shown rotated to the first stage of the encapturing configuration. As previously discussed, this first stage of arrow encapture may be achieved by manually rotating portions of arrow rest 100 and/or by drawing and then letting down a bow string of a bow to which crank arm 145 is coupled either to the bow string or to a drive cable.

Arrow rest 100 includes cover 310, which covers components disposed in a first internal cavity of body 110. Cover 310 is removably coupled to body 110 by screws 311 and 312, however any suitable means may be utilized to permanently or removably couple cover 310 to body 110. Arrow rest 100 also includes cover 320, which covers components disposed in a second internal cavity of body 110. Cover 320 is removably coupled to body 110 by screws 321 and 322, however any suitable means may be utilized to permanently or removably couple cover 310 to body 110.

Crank arm 145 is removably and adjustably coupled with shaft 375 by a set screw 344 which screws into a threaded hole in crank arm 145 and then engages with shaft 375. Shaft 375 is movably mounted in body 110, such that it is rotatable with respect to body 110, and slides into a thru hole 347 (see FIG. 3C) in crank arm 145. Crank arm 145 is thus movably mounted to body 110, first because it rotatable with respect to body 110 and second because it removably coupled/adjustably positionable with respect to shaft 375. Cord 140 passes through a thru hole 343 and is secured in place by a set screw 346 (see FIG. 3B) and/or by a set screw 348 (see FIG. 3C) secured into one or both openings of a threaded thru hole 349 (see FIGS. 3G and 3H) which intersects with thru hole 343. Thru hole 343 is near the opposite edge from the edge which is coupled to shaft 375. Crank arm 145 may be adjustably positioned left/right (with respect to FIG. 3A) on shaft 375 and rotationally on shaft 375 by loosening set screw 344 to facilitate movement of crank arm 145 and then tightening set screw 344 to maintain a desired relationship of crank arm 145 and shaft 375. This left/right adjustability of crank arm 145 along with additional left/right adjustability of arrow rest 100 with respect to arrow rest mount 150 facilitates aligning and/or positioning crank arm 145 and its axis of rotation with respect to a drive cable such as drive cable 178. In some embodiments the drive cable, crank arm 145, and cord 140 (when in a tightened state) may be positioned to be in the same plane as one another or very nearly within the same plane as one another.

On arm 126, tab 120 is removably coupled to shaft 125 by screws 354, 355 which pass through slots 350 and 351 into threaded holes 358, 357 (see FIG. 3D) in the shaft. An additional threaded hole 356 facilitates horizontal (left/right) adjustability of tab 120 along the longitudinal axis of shaft 125. The oval shape of slots 350, 351 facilitates vertical (up/down) adjustability of tab 120 with respect to the longitudinal axis of shaft 125.

On arm 136, tab 130 is removably coupled to shaft 135 by screws 364, 365 which pass through holes (obscured by shaft 135, but similar to holes 361, 360) and into threaded holes 368, 367 (see FIG. 3D) in the shaft. An additional threaded hole 366 facilitates horizontal (left/right) adjustability of tab 130 along the longitudinal axis of shaft 135. Additional holes 360, 361 facilitate vertical (up/down) adjustability of tab 120 with respect to the longitudinal axis of shaft 125.

Aperture 160 comprises the open space defined by recesses 127 and 137 as well as any gap between the closest portions of tabs 120 and 130. In FIG. 3A, the center point 399 of aperture 160 is marked with an "X." It should be appreciated that the position of center point 399, with respect to a bow to which arrow rest 100 is coupled, can be adjusted by the above described adjustments of tab 120 and tab 130 and/or the above described adjustability of arrow rest mount 150.

Typically, a manufacturer of a bow specifies the "center shot" location of the bow, where center shot refers to the arrow being in the center of the power stroke of the bow string of the bow. This may be specified, as an offset from the shelf 179 of the bow. For example, one manufacturer may specify that the center shot is 13/16 of an inch upwards from the shelf of their bow, while another manufacturer may specify that the center shot is ¾ of an inch upwards from the shelf of their bow, a for yet another manufacturer or bow model the center shot may be specified as another distance up from the bow shelf. Typically, a bow must be tuned to align the nock point(s) and/or position the arrow rest in order to position an arrow shaft such that it coincides above the shelf 179 with the center shot specified for a bow. This tuning ensures that the most power is being transmitted to the arrow from the bow string. Because rest mount 150 facilitates three-dimensional positioning of the center point 399 of aperture 160 and because the adjustability of tabs 120 and 130 facilitates further adjustable positioning of center point 399, arrow rest 100 provides true center shot adjustment that is not available with conventional arrow rests that are either fixed in position or else limited in their degree(s) or range of adjustability in comparison to arrow rest 100/arrow rest mount 150. In comparison to bows utilizing conventional arrow rests, this adjustability greatly simplifies and speeds tuning of a bow which utilizes arrow rest 100 and/or the combination of arrow rest 100 and arrow rest mount 150.

Figure 3C:
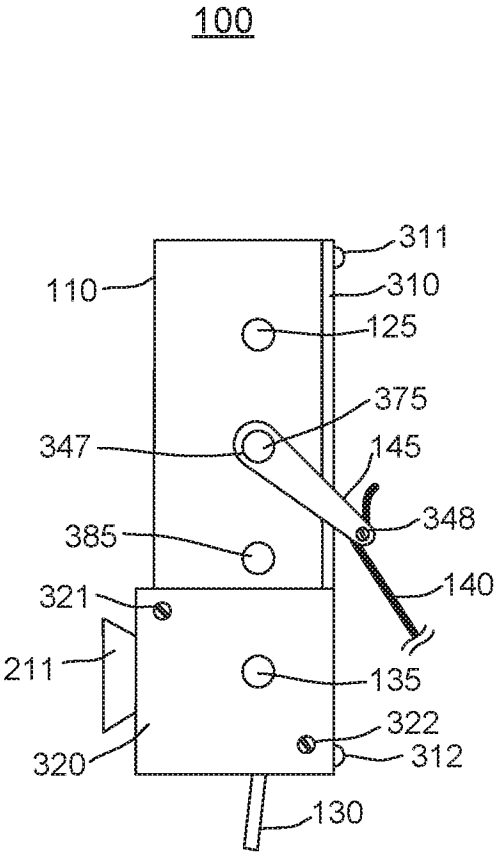
FIG. 3C shows a left side view of the arrow rest of FIG. 3A, in accordance with various aspects of the present disclosure.
Figure 3B:
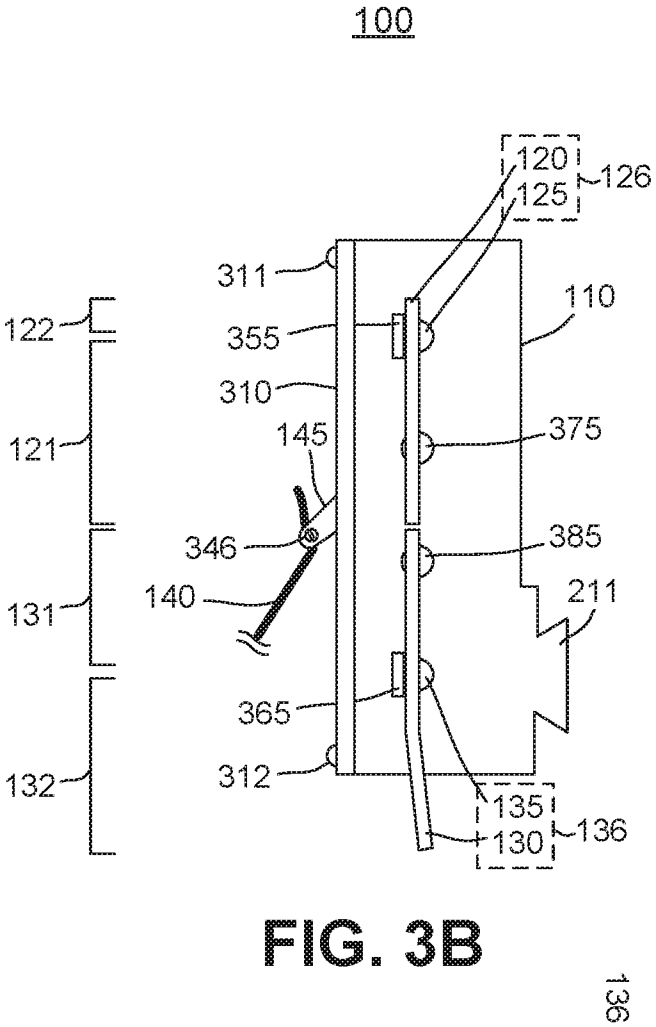
FIG. 3B shows a right side view of the arrow rest of FIG. 3A, in accordance with various aspects of the present disclosure.

FIG. 3B shows a right side view of the arrow rest 100 of FIG. 3A, in accordance with various aspects of the present disclosure. The end of shaft 385 is visible in FIG. 3B. Shaft 385 is movably mounted in body 110, such that it is rotatable with respect to body 110.

FIG. 3C shows a left side view of the arrow rest 100 of FIG. 3A, in accordance with various aspects of the present disclosure.

Figure 3D:
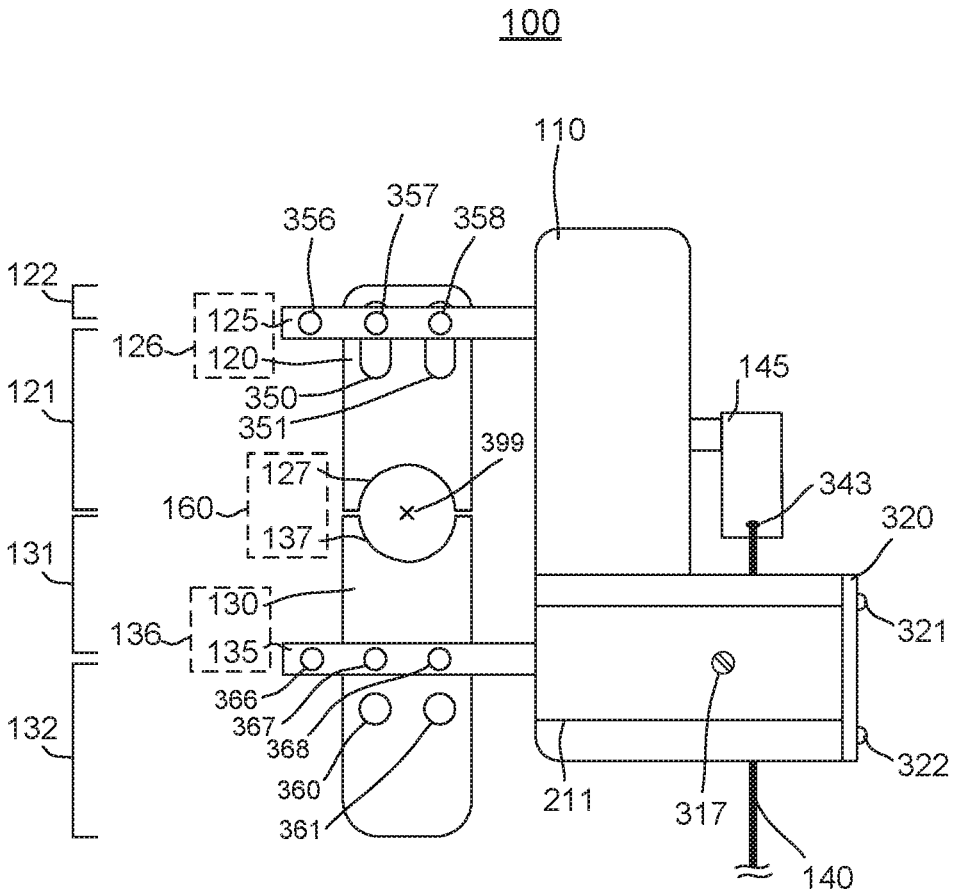
FIG. 3D shows a rear view of the arrow rest of FIG. 3A, in accordance with various aspects of the present disclosure.

FIG. 3D shows a rear view of the arrow rest 100 of FIG. 3A, in accordance with various aspects of the present disclosure. A set screw 317 is visible. Set screw 317 is used to secure one side of a spring and ball into a hole within body 110 and will be discussed in conjunction with other figures, such as FIG. 4D.

Figure 3F:
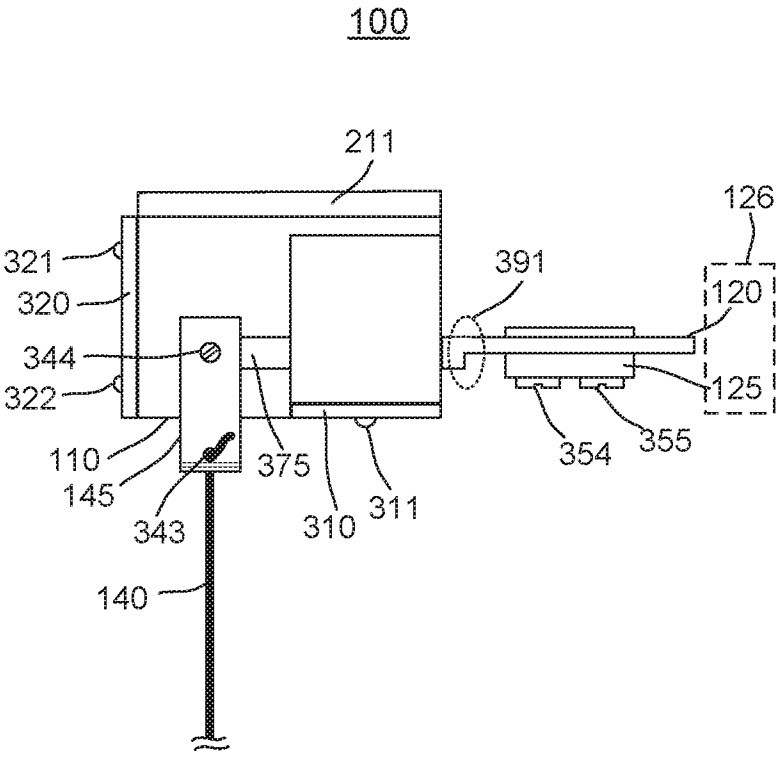
FIG. 3F shows a top view of the arrow rest of FIG. 3A, in accordance with various aspects of the present disclosure.
Figure 3E:
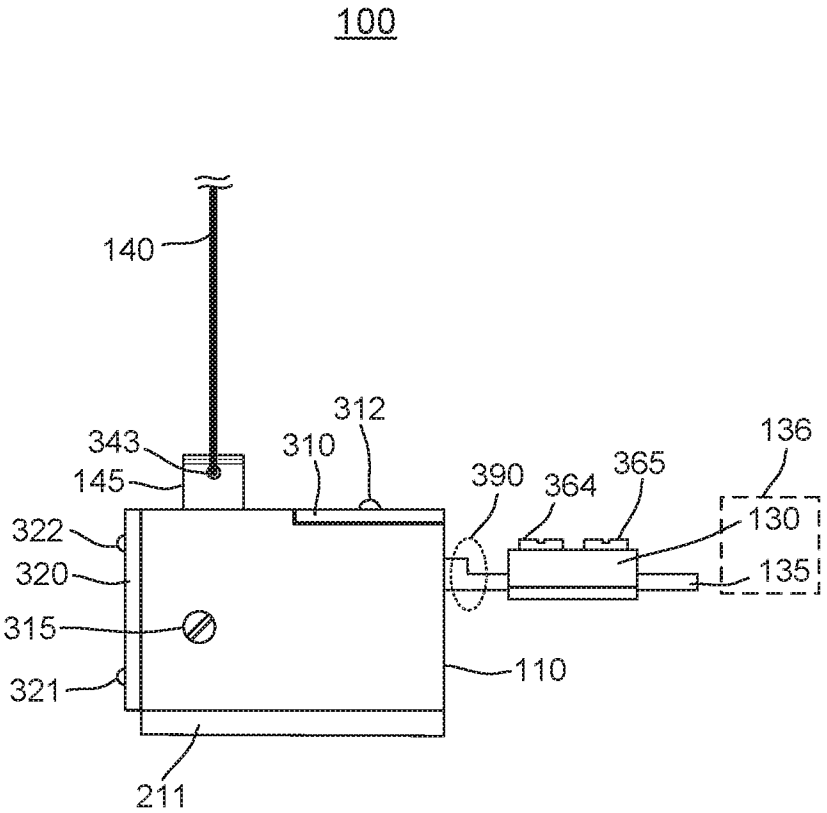
FIG. 3E shows a bottom view of the arrow rest of FIG. 3A, in accordance with various aspects of the present disclosure.

FIG. 3E shows a bottom view of the arrow rest 100 of FIG. 3A, in accordance with various aspects of the present disclosure. A set screw 315 is visible. Set screw 315 is used to limit the rotation of arms 126 and 136 and will be discussed in conjunction with other figures. Briefly though, set screw 315 extends within body 110 and acts as an adjustable stop to prevent rotation of a portion of the drive mechanism past a user selectable point. From this view in FIG. 3E, it can be observed that as shaft 135 exits body 110 its shape changes, in region 390, from a cylindrical shape inside body 110 to a hemicylindrical shape which provides a flat surface for coupling tab 130. It should be appreciated that in other embodiments, this shape change may not occur and/or the shape of shaft 135 may change from cylindrical to a different shape.

FIG. 3F shows a top view of the arrow rest 100 of FIG. 3A, in accordance with various aspects of the present disclosure. From this view, it can be observed that as shaft 125 exits body 110 its shape changes, in region 391, from a cylindrical shape inside body 110 to a hemicylindrical shape which provides a flat surface for coupling tab 120. It should be appreciated that in other embodiments, this shape change may not occur and/or the shape of shaft 125 may change from cylindrical to a different shape.

Figure 3G:
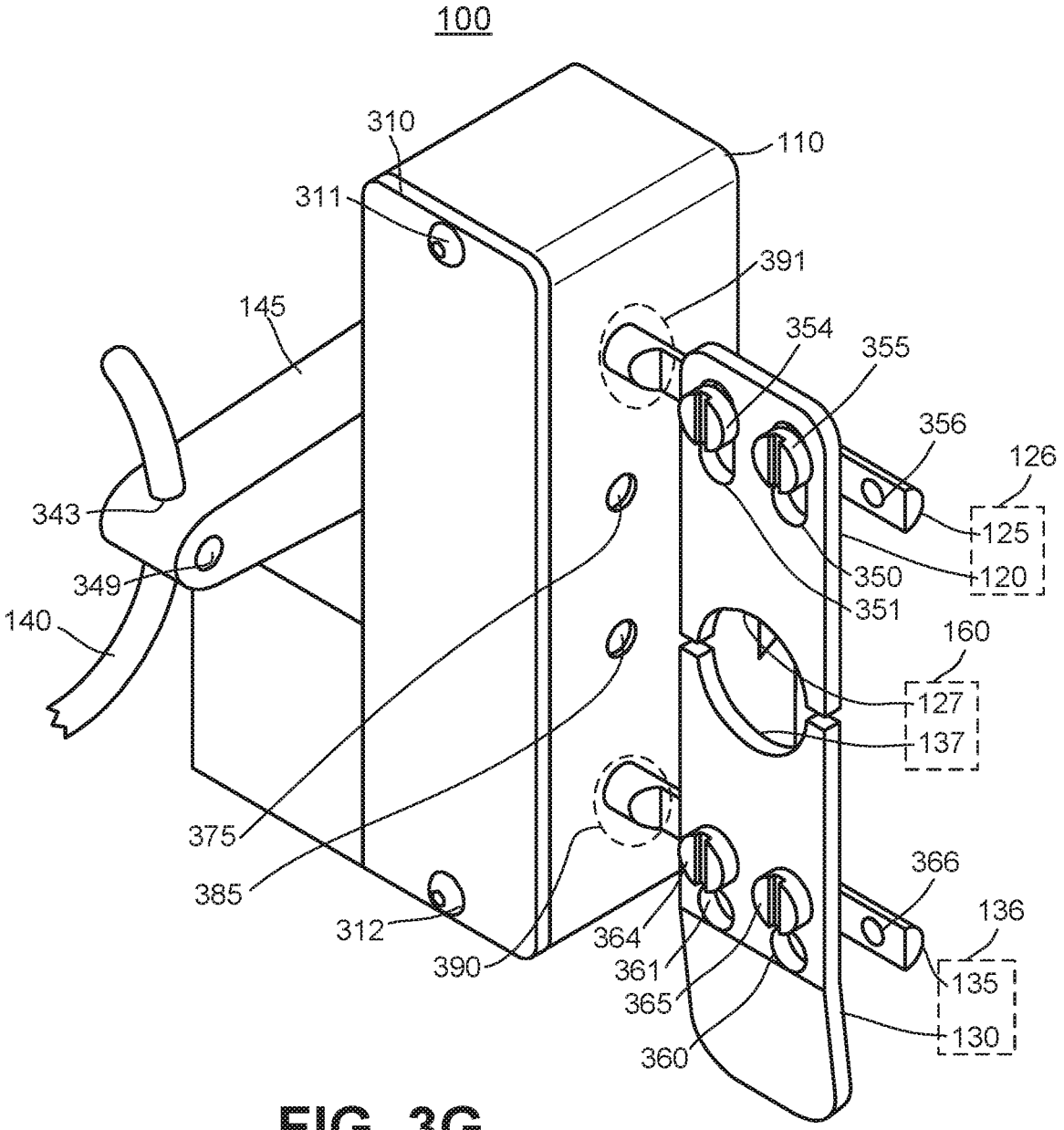
FIG. 3G shows an upper right perspective view of an arrow rest of FIG. 3A, in accordance with various aspects of the present disclosure.

FIG. 3G shows an upper right perspective view of the arrow rest 100 of FIG. 3A, in accordance with various aspects of the present disclosure. FIG. 3G illustrates arms 126 and 136 in the first stage of the encapturing configuration of arrow rest 100. From this view, it can be observed that as shaft 125 exits body 110 and in region 391 its shape changes from a cylindrical shape inside body 110 to a hemicylindrical shape which provides a flat surface for interfacing and coupling with tab 120. Likewise, as shaft 135 exits body 110 and in region 390 its shape changes from a cylindrical shape inside body 110 to a hemicylindrical shape which provides a flat surface for interfacing and coupling with tab 130. It should be appreciated that other shapes/facings of shafts 125 and 135 are possible where the shafts interface with the tabs, including round, square, and triangular, among others.

Figure 3H:
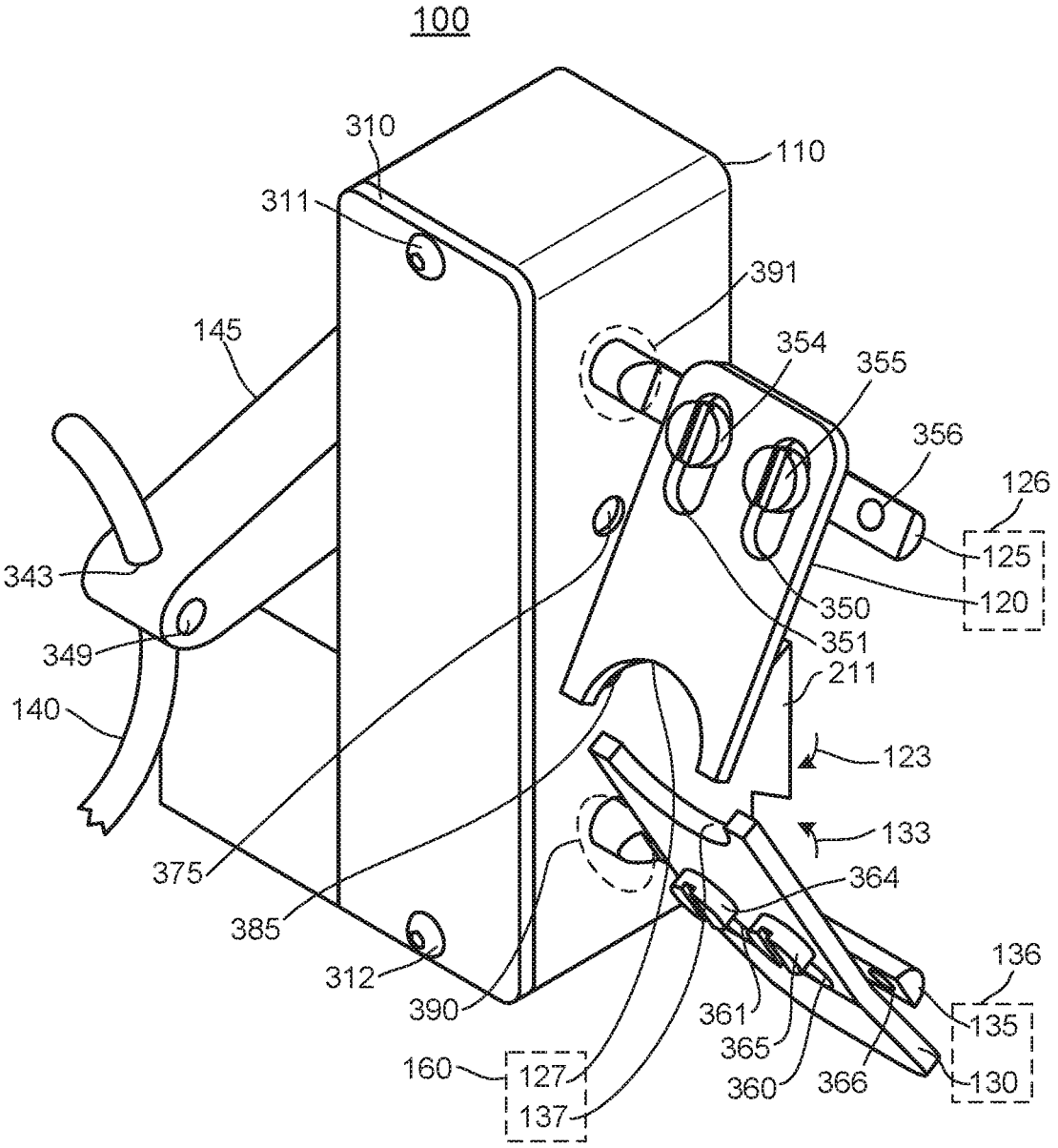
FIG. 3H shows an upper right perspective view of the arrow rest of FIG. 3A, in accordance with various aspects of the present disclosure.

FIG. 3H shows an upper right perspective view of the arrow rest 100 of FIG. 3A, in accordance with various aspects of the present disclosure. FIG. 3H illustrates arms 126 and 136 rotated to the second stage of the encapturing configuration of arrow rest 100.

Figure 3I:
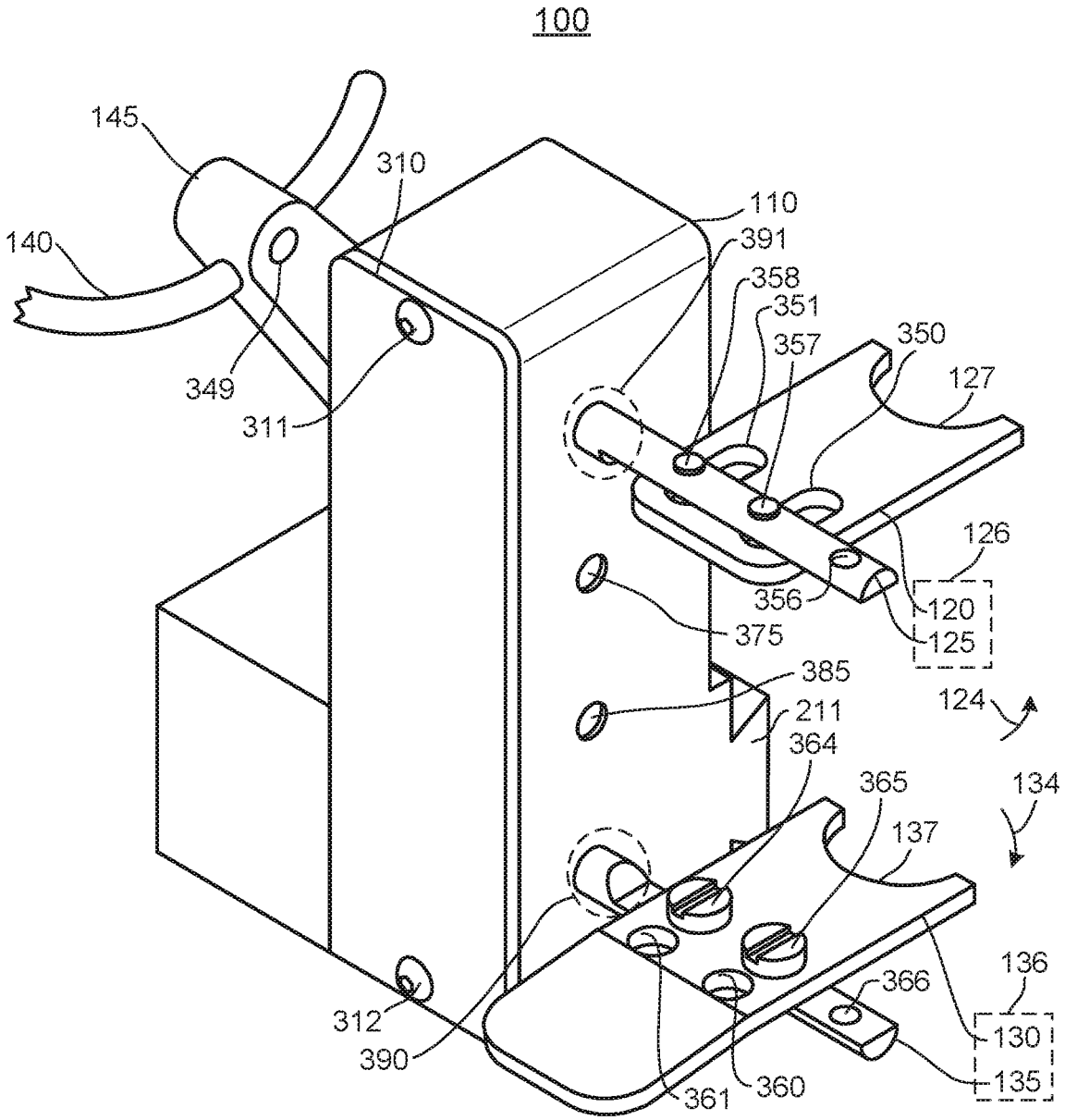
FIG. 3I shows an upper right perspective view of the arrow rest of FIG. 3A, in accordance with various aspects of the present disclosure.

FIG. 3I shows an upper right perspective view of the arrow rest 100 of FIG. 3A, in accordance with various aspects of the present disclosure. FIG. 3I illustrates arms 126 and 136 rotated to the discharge configuration of arrow rest 100.

Figure 4A:
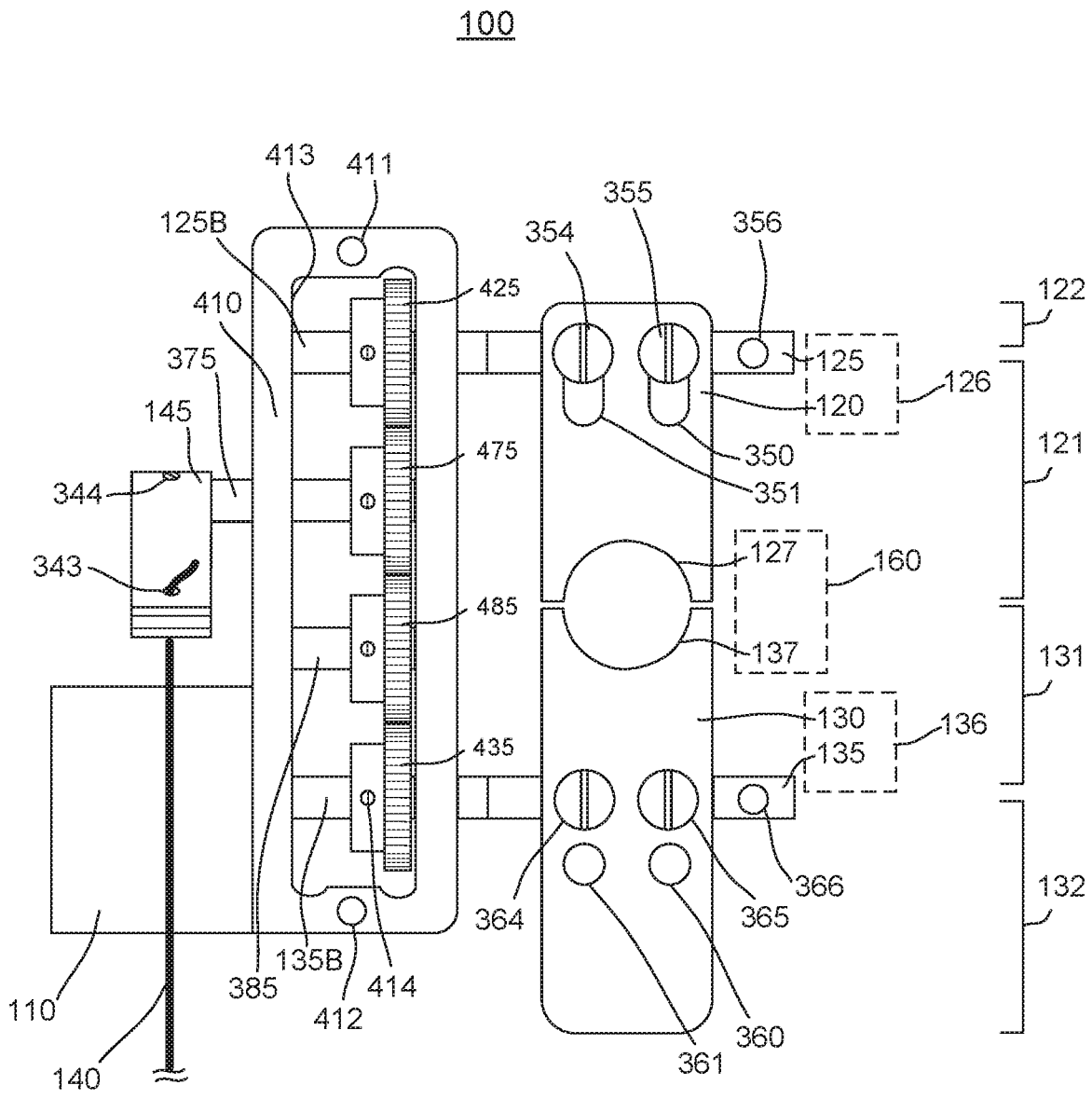
FIG. 4A shows a front view of the arrow rest of FIG. 3A with both covers removed and the arrow rest in a first stage of an encapturing configuration, in accordance with various aspects of the present disclosure.

FIG. 4A shows a front view of the arrow rest 100 of FIG. 3A with both covers 310 and 320 removed and the arrow rest 100 in a first stage of an encapturing configuration, in accordance with various aspects of the present disclosure. In this view, portion 121 of tab 120/arm 126 and portion 131 of tab 130/arm 136 are substantially aligned with and in plane with one another. By "substantially aligned" and "substantially in plane," what is meant is that these portions are either aligned and in plane with one another or are within a few degrees of being aligned and in plane with one another.

Removal of cover 310 exposes cavity 413 which is defined within body 110. Surface 410, which was not visible in FIG. 3A, is now visible. Threaded holes 411 and 412 provide the means for securing cover 310 with screws 311 and 312 (as was illustrated in FIG. 3A). Previously, only the first portions of shafts 125 and 135 that extended outside of body 110 were visible. However, with cover 310 removed, it can be seen that second portions 125B and 135B of each of these respective shafts 125 and 135 extend through the cavity 413 defined within body 110 and are rotatably secured in, mounted with, and supported by holes that are in two opposing walls of this cavity 413 of body 110. Though not depicted, bearings fixed in the walls of cavity 413 may be utilized to support one or more of shafts 125, 135, 375, and 385. A gear 435 is secured to shaft 135 by a set screw 414 which is tightened through a threaded hole in the collar of gear 435 until it engages with shaft 135. Gear 435 is similarly fixed by a set screw to the portion of shaft 125 that is within cavity 413. Likewise, a gear 485 is fixed to shaft 385 by a set screw, and a gear 475 is fixed to shaft 375 by a set screw. It should be appreciated that the use of the set screws allows the gears to be adjustably positioned on their respective shafts, and once a desired configuration is achieved the set screws can be tightened to hold their respective gears in place on their respective shafts. In the illustrated arrangement, the gears are meshed together, and when shaft 135 turns gear 435 engages with gear 485 to turn shaft 385 in an opposite direction to the rotation of shaft 135. Similarly, gear 485 engages with gear 475 and causes it to turn shaft 375 and crank arm 145 in an opposite direction of the rotation of shaft 385. Finally, gear 475 engages with gear 425 and causes it to turn shaft 125 in an opposite direction to the rotation of shaft 375. Looking at the arrangement in whole, when any shaft (125, 135, 375, 385) is rotated, then all the other shafts are caused to rotate at the same time with shafts 135 and 375 rotating in synchronization with one another in the same direction of rotation as one another and shafts 125 and 385 rotating in synchronization with one another and in the same direction as one another. In this manner, all of the shafts are rotationally coupled with one another and operate to rotate in synchronization, but two rotate opposite the direction of rotation of the other two. Thus, due to the rotational coupling, when arm 126 rotates about the longitudinal axis of shaft 125, it rotates in synchronization with but in an opposite direction of any rotation of the arm 136. It should be appreciated that although four shafts and four gears are illustrated in FIG. 4A, in order to cause arms 126 and 136 to rotate in synchronization but in opposite direction (i.e., to counter rotate), any even number of similarly arranged geared shafts may be employed, as may other geared and non-geared rotationally reversing arrangements.

Figure 4C:
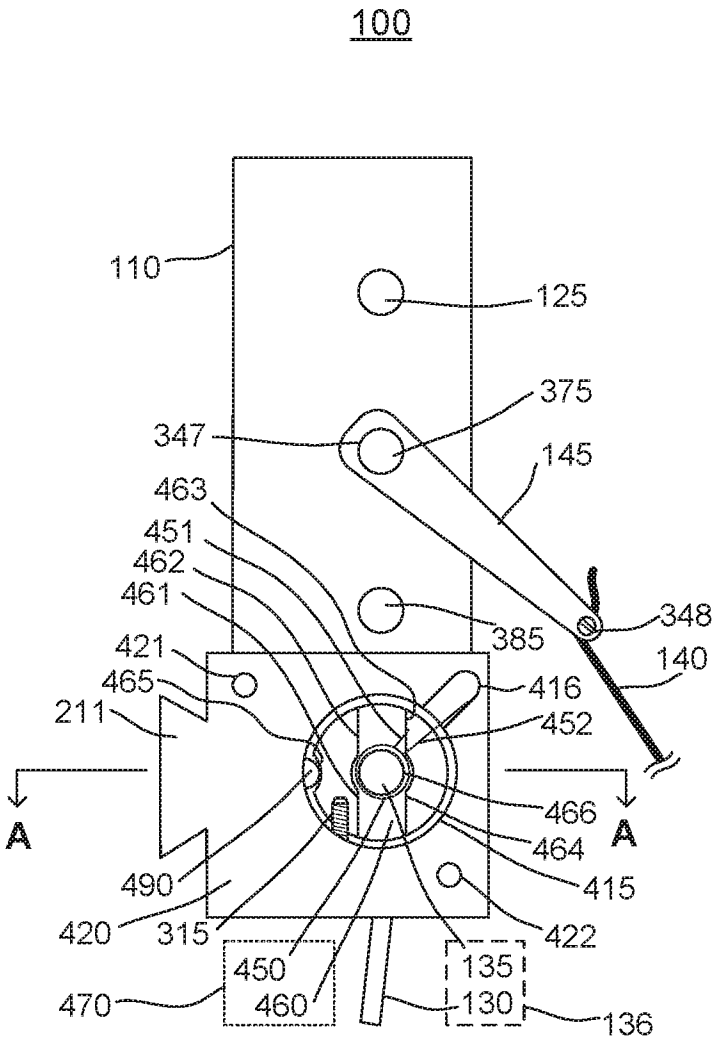
FIG. 4C shows a left side view of the arrow rest of FIG. 3A with both covers removed and the arrow rest in the first stage of the encapturing configuration, in accordance with various aspects of the present disclosure.
Figure 4B:
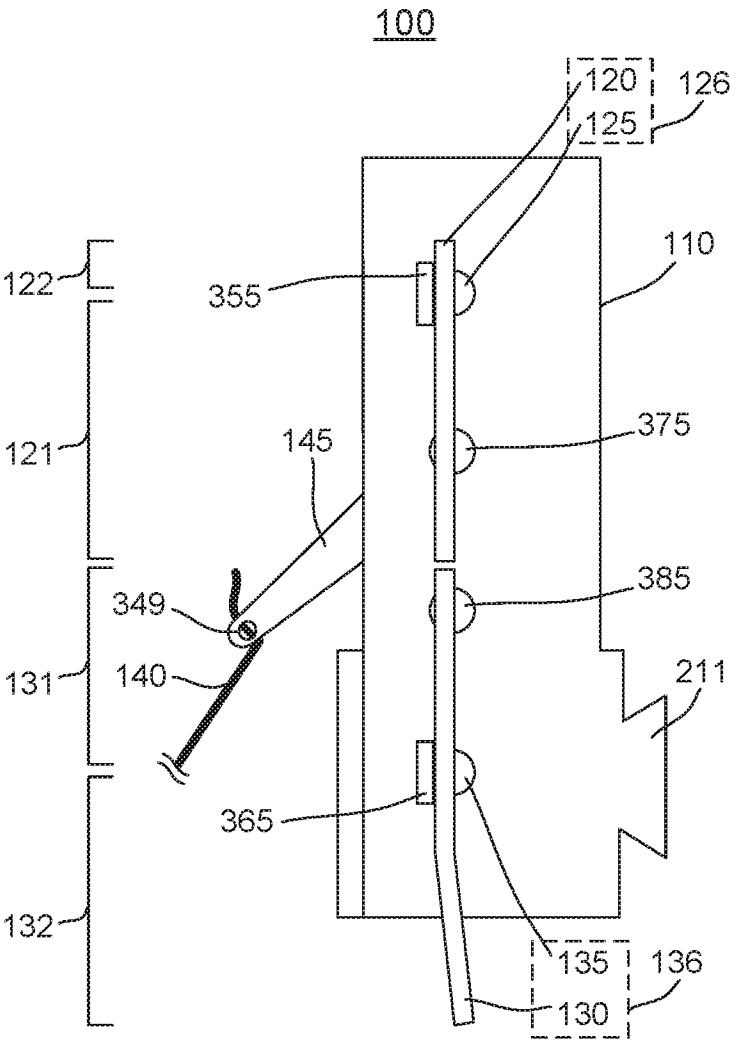
FIG. 4B shows a right side view of the arrow rest of FIG. 3A with both covers removed and the arrow rest in the first stage of the encapturing configuration, in accordance with various aspects of the present disclosure.

FIG. 4B shows a right side view of the arrow rest 100 of FIG. 3A with both covers 310 and 320 removed and the arrow rest 100 in the first stage of the encapturing configuration, in accordance with various aspects of the present disclosure.

FIG. 4C shows a left side view of the arrow rest 100 of FIG. 3A with both covers 310 and 320 removed and the arrow rest 100 in the first stage of the encapturing configuration, in accordance with various aspects of the present disclosure. Section markings indicated the direction of a Sectional view A-A that is presented in FIG. 4D. The left side view of FIG. 4C exposes cavity 415 which is defined in body 110. Surface 420, which was not visible in FIG. 3C, is now visible. A small depression 416 is configured into surface 420 of body 110. Threaded holes 421 and 422 provide the means for securing cover 320 with screws 321 and 322 (as was illustrated in FIG. 3A). Drive mechanism 470 is disposed within cavity 415.

Drive mechanism 470 comprises cam 460 and biasing means 450. Cam 460 is coupled with shaft 135, which provides a connection between cam 460 and arm 126 of which shaft 135 is a portion. Cam 460 is disposed coaxially with shaft 135 by sliding shaft 135 through thru hole 466 of cam 460, and then fixing cam 460 in place with a set screw 495 (visible in FIG. 4D). Cam 460 has a barrel and a rotor which are further described in other figures. Four contact surfaces (461, 462, 463, and 464) of the rotor are identified, and one feature, detent 465, of the barrel is identified.

As depicted, biasing means 450 is a torsion spring that is disposed coaxially with shaft 135 and cam 460. However other biasing means such as stretched strings, clock springs, magnets, and/or elastic bands may be utilized to similarly bias the rotation of shaft 135 and cam 460. In some embodiments, more than one of these or other biasing means may be used in combination. Referring again to FIG. 4C, the coils of torsion spring 450 are coaxial with shaft 135. A first leg 451 of torsion spring 450 interfaces with surface 463 of cam 460, while the second leg 452 on the other end of the coils interfaces with an interior surface of depression 416 and is held in place within and coupled with depression 416 of body 110 when cover 320 is secured onto body 110. Torsion spring 450 is under load when installed as depicted and operates to provide a rotational bias to urge rotation of cam 460 from the depicted position that corresponds with the first stage of the encapturing configuration of arrow rest 100 to a second position (illustrated in FIG. 6C) that corresponds to the discharge configuration of arrow rest 100. Put differently, the biasing means (e.g., torsion spring 450) is coupled with both cam 460 and body 110 and operates to urge rotation of cam 460 such that the first arm 126 and the second arm 136, which are rotationally coupled, are urged from the encapturing configuration of the arrow rest 100 (depicted in FIG. 3A, FIG. 4A, and FIG. 5A) to the discharge configuration of arrow rest 100 (depicted in FIG. 6A).

In the first stage of the encapturing configuration, a spring (see spring 491 of FIG. 4D) pushes ball 490 into detent 465 where it engages with and releasably holds cam 460, and thus arms 126 and 136, in the encapturing configuration against the rotational urge provided by torsion spring 450 or other biasing means. As can be seen from FIGS. 4A and 4C, crank arm 145 is rotationally coupled to drive mechanism 470 via the depicted gearing (see e.g., gears 475, 485, and 435 in FIG. 4A), such that rotation of crank arm 145 causes rotation of the rotating portions of drive mechanism 470. Likewise, rotation of drive mechanism 470 causes rotation of crank arm 145. Because of the gearing (see FIG. 4A) the rotating portions of drive mechanism 470 and crank arm 145 rotate in synchronization with and in the same direction of rotation as one another. Accordingly, rotation of crank arm 145 in one direction, rotates arms 126 and 136 toward the encapturing configuration, while rotation of crank arm 145 in an opposite direction rotates arms 126 and 136 toward the discharge configuration.

Set screw 315 acts as an adjustable rotational stop to cam 460 when it engages with either surface 461 or surface 462. Set screw 315 may be adjusted in or out to change the point in the rotation of cam 460 at which surface 462 engages with set screw 315 and thus to adjust and set the angle of positioning of tabs 120 and 130 when arrow rest 100 is in the discharge configuration. Effectively, the positioning of set screw 315 sets the configuration of arms 126 and 136 in the discharge configuration and prevents rotation of cam 460 beyond this discharge configuration.

Figure 4D:
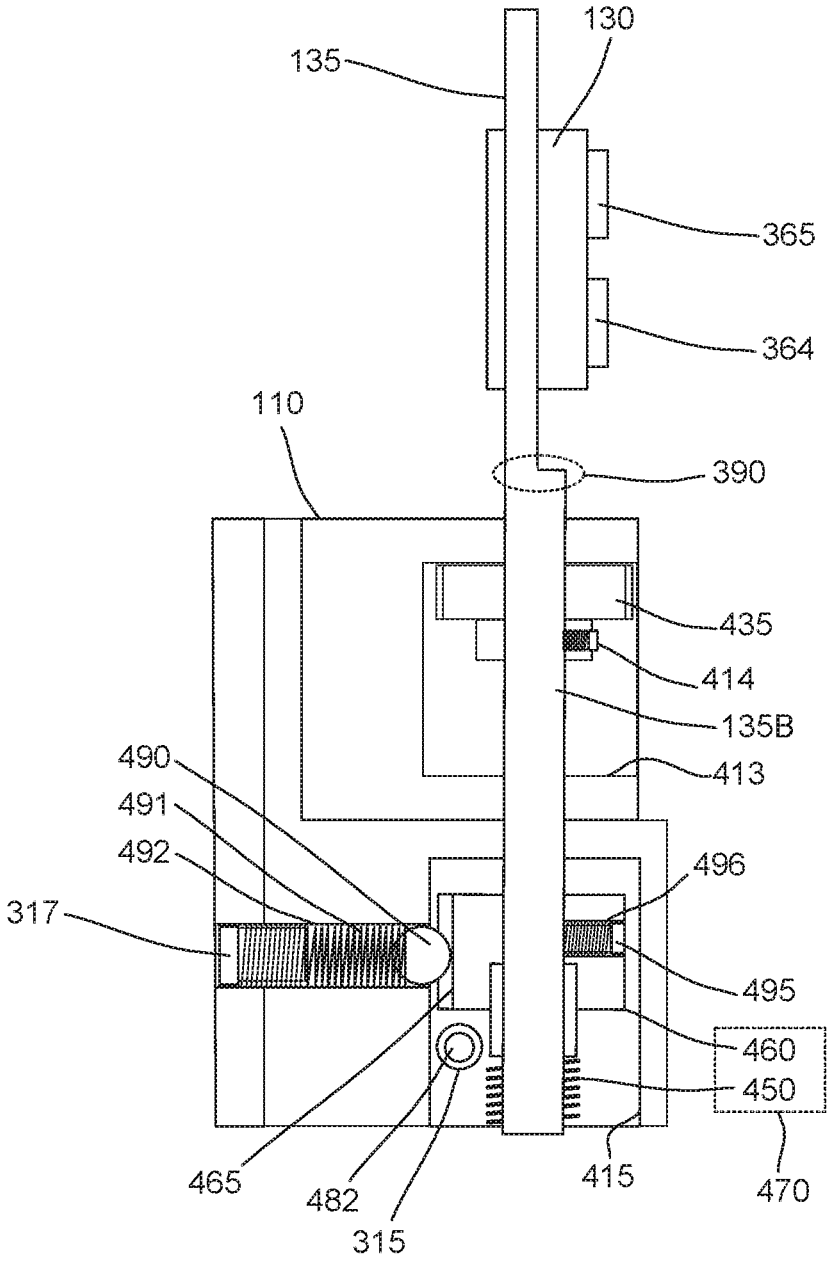
FIG. 4D shows a sectional view A-A of the arrow rest of FIG. 4C, in accordance with various aspects of the present disclosure.

FIG. 4D shows a sectional view A-A of the arrow rest 100 of FIG. 4C, in accordance with various aspects of the present disclosure. The coils of spring 450 are visible in their coplanar arrangement with shaft 135, as is the coplanar positioning of cam 460 on shaft 135. A tip 482 of set screw 315 is more visible. It is tip 482 that acts as an adjustable stop which engages with contact surface 462 of cam 460 and prevents rotation of cam 460 past the adjustably preset discharge configuration of arms 126 and 136. In some embodiments, tip 482 may be polymer coated or covered with other sound deadening material to reduce sound which might result from engaging with contact surface 462.

Set screw 495 is visible interacting with threads of threaded hole 496 to removably fix cam 460 in place as its tip engages into shaft 135.

Set screw 317 is visible within threaded hole 492. A spring 491 is positioned between set screw 317 and ball 490, such that ball 490 is spring-loaded. Set screw 317 may be adjusted to adjust the spring tension of spring 491 such that the biasing force applied by spring 491 to hold ball 490 in detent 465 may be adjusted. For example, inward adjustment of set screw 317 increases compression of the retained spring 491 and thus increases the force applied to ball 490 and the holding power of ball 490 within detent 465. Conversely outward adjustment of set screw 317 decreases the compression of the retained spring 491, and thus decreases the force applied to ball 490 and the holding power of ball 490 within detent 465.

Figure 5A:
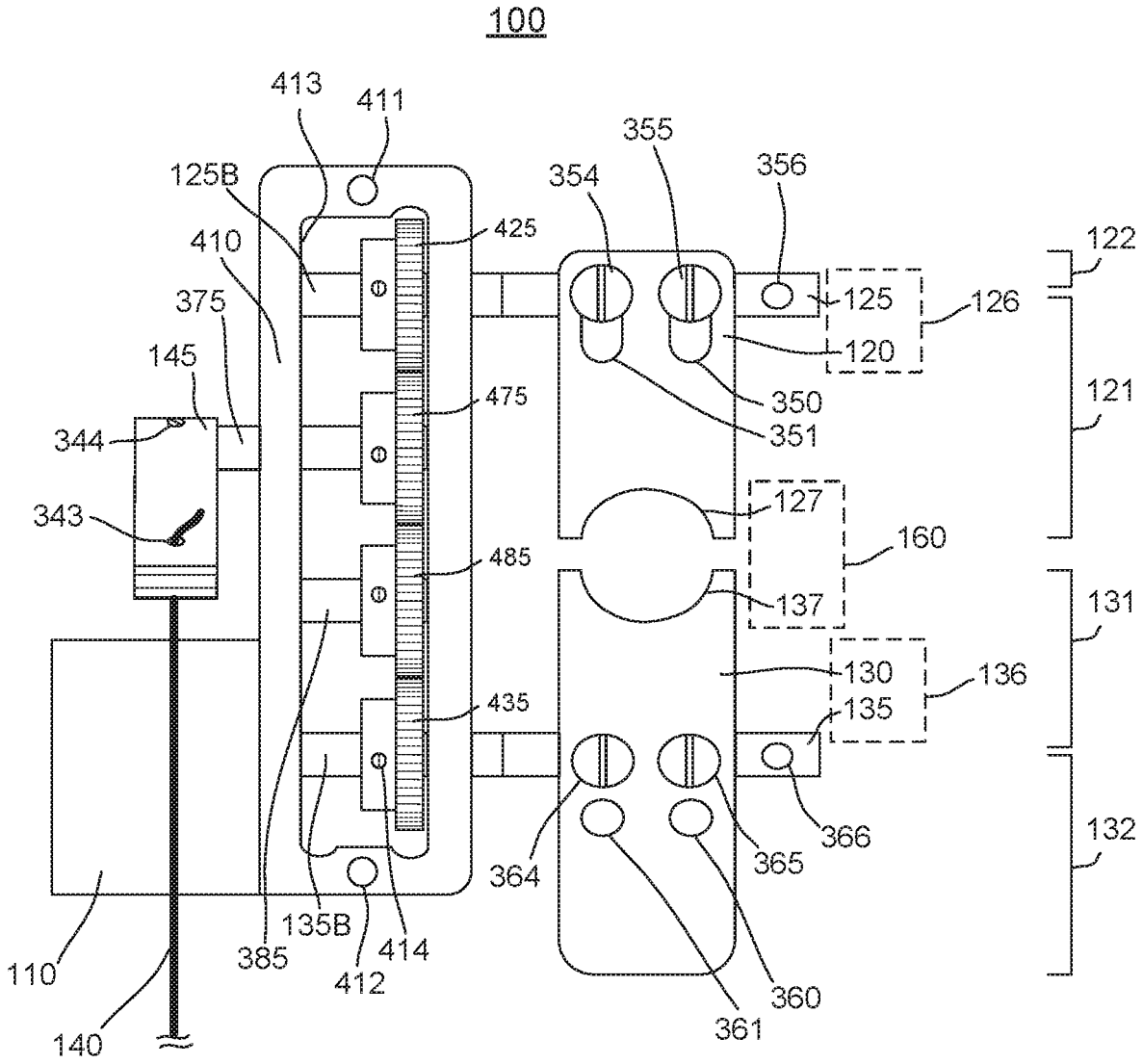
FIG. 5A shows a front view of the arrow rest of FIG. 3A with both covers removed and the arrow rest in the second stage of the encapturing configuration which would occur with a drawn bow, in accordance with various aspects of the present disclosure.

FIG. 5A shows a front view of the arrow rest 100 of FIG. 3A with both covers 310 and 320 removed and the arrow rest 100 in the second stage of the encapturing configuration which would occur with a drawn bow, in accordance with various aspects of the present disclosure. The difference in FIG. 5A as compared to FIG. 4A is that portions 121 and 131 of arms 126 and 136 have rotated slightly toward the viewer's eye, crank arm 145 has rotated slightly downward, and each of the shafts 135, 385, 375, and 125 has rotated slightly (shafts 125 and 385 have rotated slightly up with respect to the image view, while shafts 135 and 375 have rotated slightly down with respect to the image view).

Figure 5C:
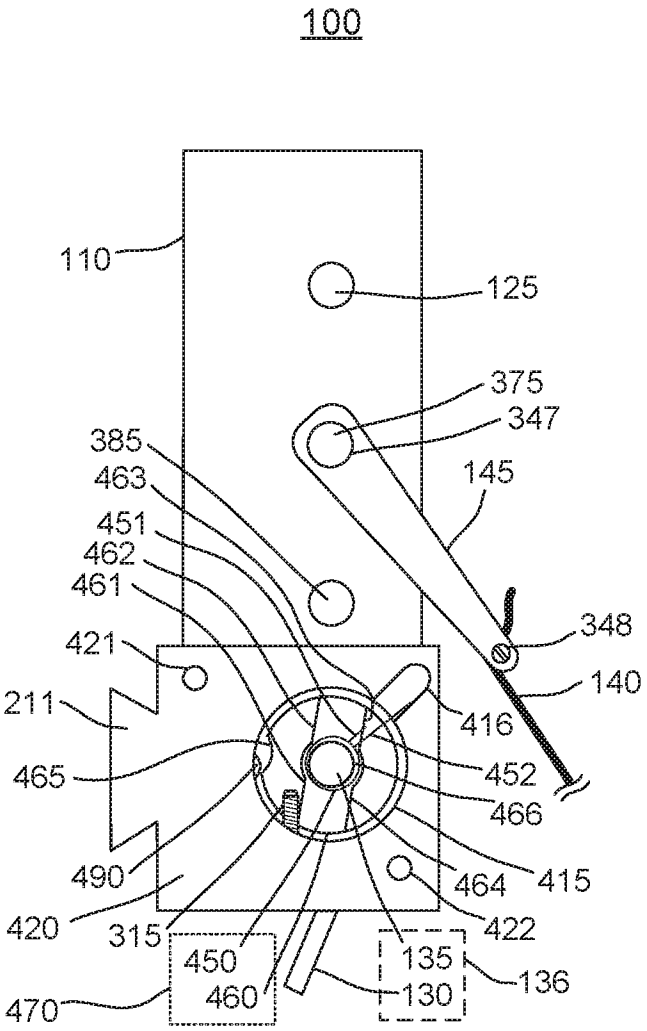
FIG. 5C shows a left side view of the arrow rest of FIG. 3A with both covers removed and the arrow rest in the second stage of the encapturing configuration which would occur with a drawn bow, in accordance with various aspects of the present disclosure.
Figure 5B:
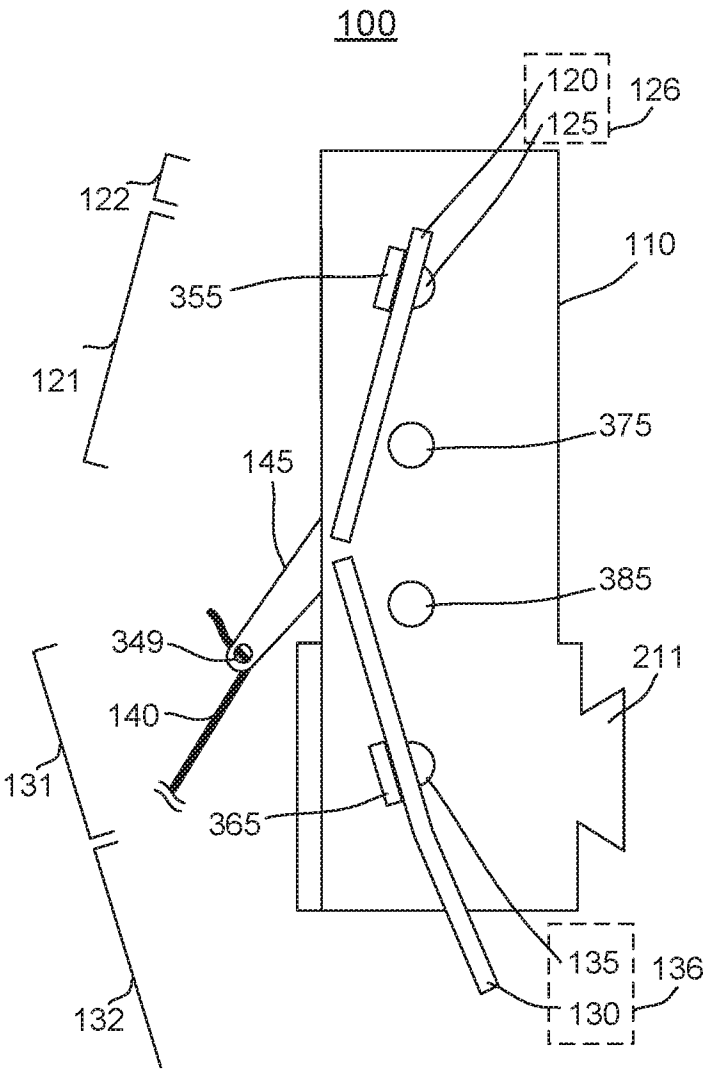
FIG. 5B shows a right side view of the arrow rest of FIG. 3A with both covers removed and the arrow rest in the second stage of the encapturing configuration which would occur with a drawn bow, in accordance with various aspects of the present disclosure.

FIG. 5B shows a right side view of the arrow rest 100 of FIG. 3A with both covers 310 and 320 removed and the arrow rest 100 in the second stage of the encapturing configuration which would occur with a drawn bow, in accordance with various aspects of the present disclosure.

FIG. 5C shows a left side view of the arrow rest 100 of FIG. 3A with both covers 310 and 320 removed and the arrow rest 100 in the second stage of the encapturing configuration which would occur with a fully or near fully drawn bow, in accordance with various aspects of the present disclosure. As compared to FIG. 4C, cam 460 has been rotated slightly clockwise until surface 461 has come into contact with set screw 315. In some embodiments, this contact is not required and may not occur. However, the point of contact and the arrangement of arms 126 and 136 when this contact occurs can be adjusted by the positioning of shaft 135 when set screw 315 is engaged. In this manner, the rotational positioning of arms 126 and 136 in the encapturing and discharge configurations can be adjusted. For example, the second stage of the encapturing configuration can be adjustably set to correspond with fully drawing a bow string of the bow to which arrow rest 100 is coupled. This full draw of the bow string can occur when an arrow in arrow rest 100 is fully drawn or with the bow string is fully drawn without an arrow in arrow rest 100. Because of the rotation of cam 460, ball 490 is no longer engaged with detent 465, but is instead compressed into hole 492 by the barrel of cam 460. In some embodiments of this second stage of the encapturing configuration, ball 490 may be partially or completely out of detent 465. In this position, in the second stage of the encapturing configuration, increased torsional load has been placed on torsion spring 450 such that the biasing urge to rotate cam 460 in the counterclockwise direction (with respect to FIG. 5C) has been increased as compared to the biasing urge of FIG. 4C.

Figure 6A:
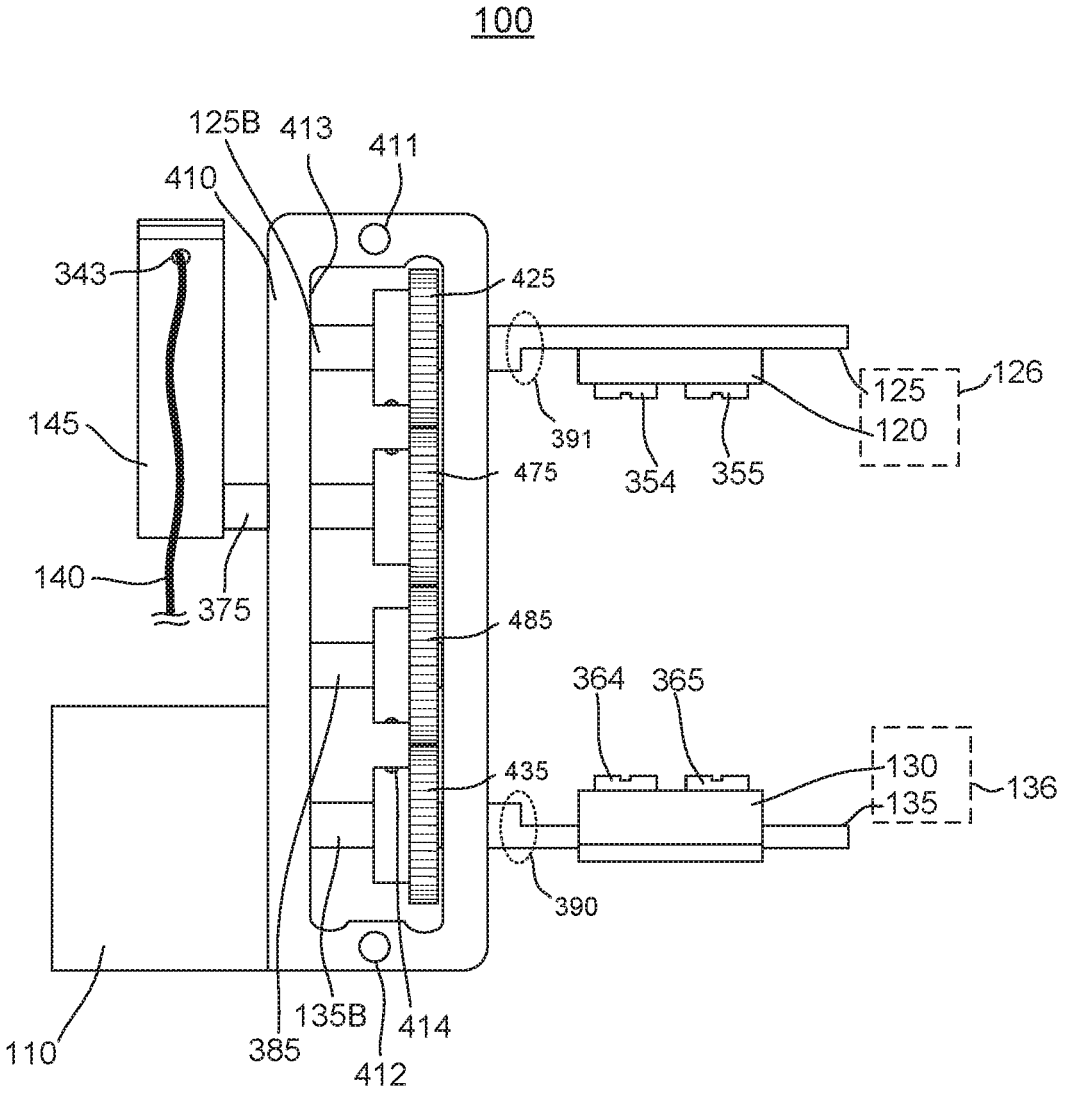
FIG. 6A shows a front view of the arrow rest of FIG. 3A with both covers removed and the arrow rest in a discharge configuration, in accordance with various aspects of the present disclosure.
Figure 6C:
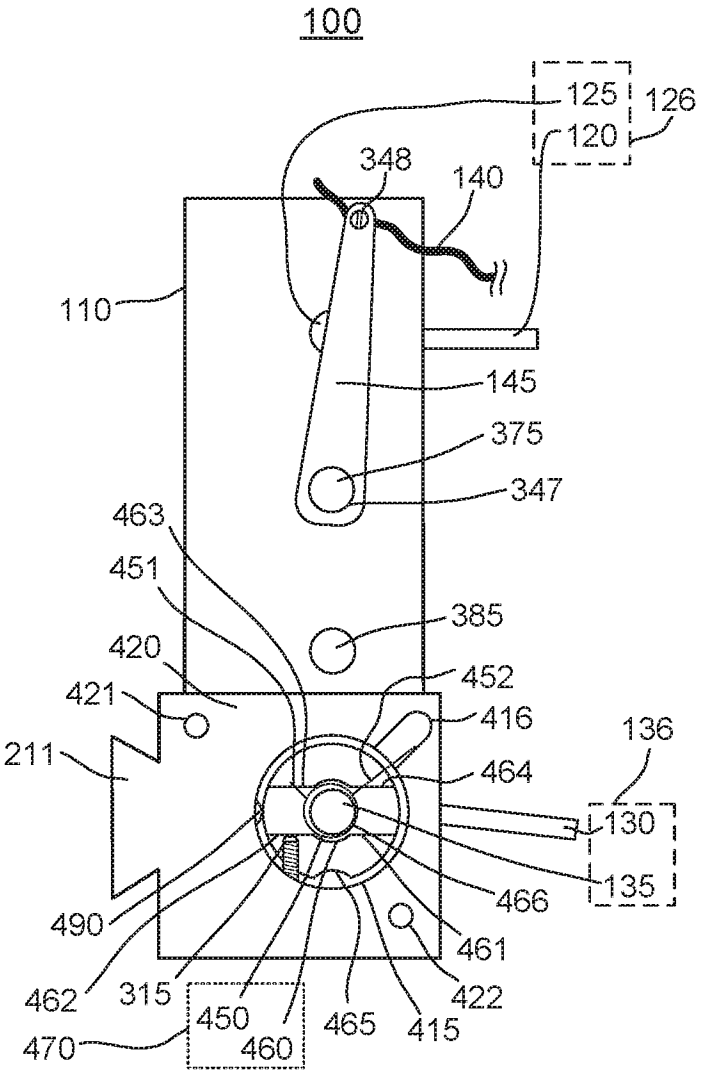
FIG. 6C shows a left side view of the arrow rest of FIG. 3A with both covers removed and the arrow rest in the discharge configuration, in accordance with various aspects of the present disclosure.

Responsive to firing the bow (i.e., release of bow string 176 from its pulled position) friction of the detent 465 that would normally permit engagement of ball 490 to releasably hold cam 460 from rotation is overcome by rapid movement of cam 460 under motivational urge from the biasing means (e.g., torsion spring 450) such that the biasing means rotates the cam counterclockwise (with respect to FIG. 5C) until set screw 315 engages surface 462 (as shown in FIG. 6C) at the point when drive mechanism 470 has driven arms 126 and 136 to the discharge configuration of arrow rest 100. In general, this rotation creates very little sound as compared to conventional arrow rests in which the fletching of the arrow is required to impact the arrow rest as the arrow flies through the arrow rest. When hunting game with a bow, this decreased sound reduces noise associated with firing of a bow which can startle a game animal into moving before the fired arrow transits from the bow to impact the animal.

FIG. 6A shows a front view of the arrow rest 100 of FIG. 3A with both covers 310 and 320 removed and the arrow rest 100 in a discharge configuration, in accordance with various aspects of the present disclosure. As compared to FIGS. 4A and 5A, portions 121 and 131 (see FIG. 6B) of arms 126 and 136 have rotated away from the viewer's eye and are now substantially parallel to one another (but in different planes from one another as compared to FIG. 4A when they were in or substantially in the same plane as one another), crank arm 145 has rotated upward, and each of the shafts 135, 385, 375, and 125 has rotated (shafts 125 and 385 have rotated down with respect to the image view, while shafts 135 and 375 have rotated up with respect to the image view).

Figure 6B:
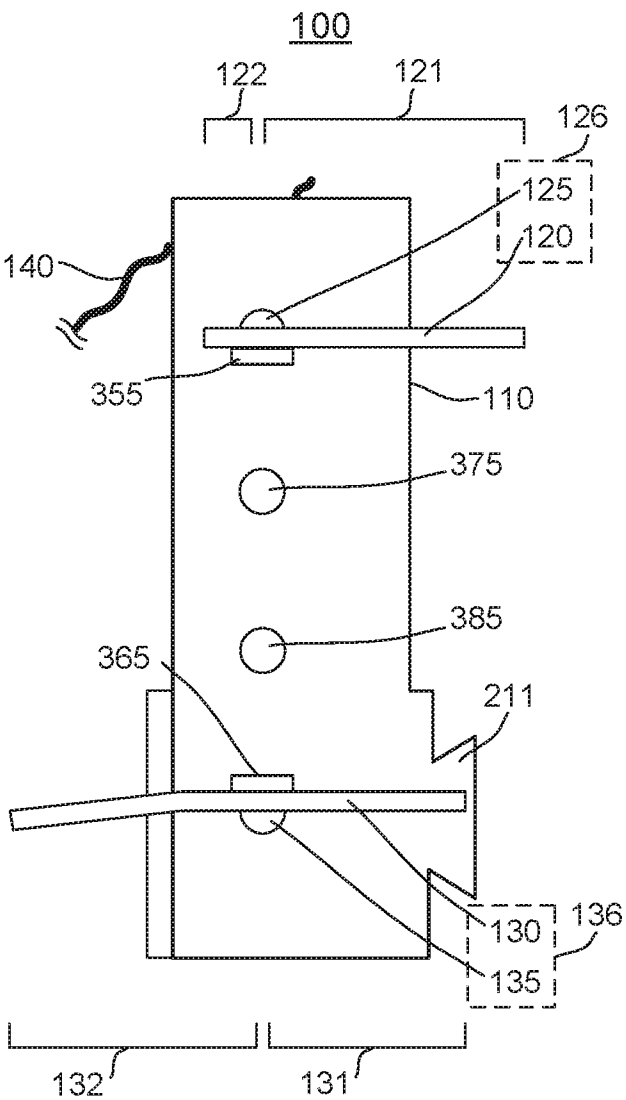
FIG. 6B shows a right side view of the arrow rest of FIG. 3A with both covers removed and the arrow rest in the discharge configuration, in accordance with various aspects of the present disclosure.

FIG. 6B shows a right side view of the arrow rest 100 of FIG. 3A with both covers 310 and 320 removed and the arrow rest 100 in the discharge configuration, in accordance with various aspects of the present disclosure.

FIG. 6C shows a left side view of the arrow rest 100 of FIG. 3A with both covers 310 and 320 removed and the arrow rest 100 in the discharge configuration, in accordance with various aspects of the present disclosure. Cam 460 has rotated until set screw 315 is engaged with surface 462, which is at the point when drive mechanism 470 has driven arms 126 and 136 to the discharge configuration of arrow rest 100.

Figure 7A:
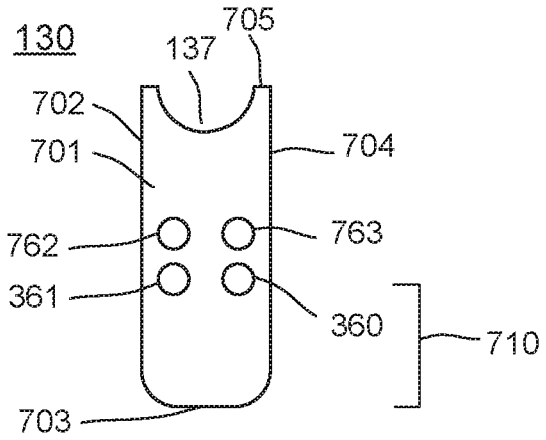
FIG. 7A shows a front view of the lower tab of the arrow rest of FIG. 3A, in accordance with various aspects of the present disclosure.

FIG. 7A shows a front view of the lower tab 130 of the arrow rest 100 of FIG. 3A, in accordance with various aspects of the present disclosure. The rear view is substantially the same. It should be appreciated that lower tab 130 may be used in place of upper tab 120 such that two versions of lower tab 130 are employed on each of the two arms 126, 136 in an arrow rest 100. Lower tab 130 is somewhat rectangular in shape, except for recess 137, and may have one or more rounded corners. Lower tab 130 includes a front surface 701, a left edge surface 702, a bottom edge surface 703, a right edge surface 704, and a top edge surface 705. Recess 137 is semi-circular and configured to encapture, and in some instances engage with and/or support a portion of the circumference of the shaft of an arrow. Although depicted as semi-circular, recess 137 may have other shapes (e.g., triangular, rectangular, pentagonal) in other embodiments. Holes 360, 361, 762, and 763 facilitate adjustable positioning of lower tab 130 along the longitudinal axis of a shaft (e.g., shaft 135 and/or shaft 125) and also permit adjustable radial positioning of lower tab 130 with respect to the longitudinal axis of the same shaft to which it is coupled. Region 710 represents a region that an operator may engage with their thumb, such as to rotate the rest into the first stage of arrow encapture. Lower tab 130 can be constructed of any suitable material including metal, plastic, and wood, among others. In some embodiments, all or some portions of lower tab 130 may be coated with one or more materials to reduce noise, reduce friction, and/or reduce reflection of light. For example, recess 137 may be coated with plastic, rubber, or felt to reduce noise that may occur during contact with the shaft of an arrow. In some embodiments, lower tab 130 may employ slots like those of upper tab 120, rather than or in addition to one or more of holes 360, 361, 762, and 763.

Figure 7B:
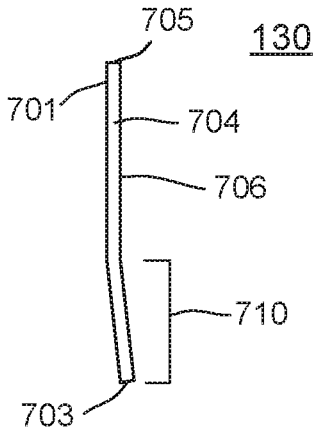
FIG. 7B shows a right side view of the lower tab of the arrow rest of FIG. 3A, in accordance with various aspects of the present disclosure.

FIG. 7B shows a right side view of the lower tab 130 of the arrow rest 100 of FIG. 3A, in accordance with various aspects of the present disclosure. The left side view is a mirror image of the right side view. The right side view shows the rear surface 706 of lower tab 130 and also shows that region 710 is slightly angled with respect to the remainder of lower tab 130.

Figure 8A:
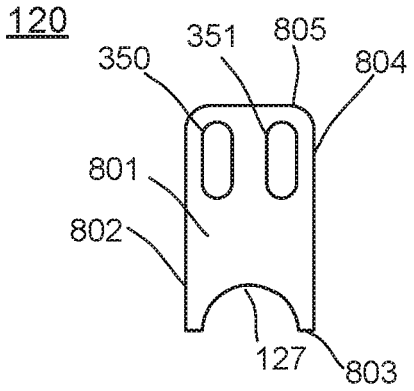
FIG. 8A shows a front view of the upper tab of the arrow rest of FIG. 3A, in accordance with various aspects of the present disclosure.

FIG. 8A shows a front view of the upper tab 120 of the arrow rest 100 of FIG. 3A, in accordance with various aspects of the present disclosure. The rear view is substantially the same. It should be appreciated that upper tab 120 may be used in place of lower tab 130 such that two versions of upper tab 120 are employed on each of the two arms 126, 136 in an arrow rest 100. Upper tab 120 is somewhat rectangular in shape, except for recess 127, and may have one or more rounded corners. Upper tab 120 includes a front surface 801, a left edge surface 802, a bottom edge surface 803, a right edge surface 804, and a top edge surface 805. Recess 127 is semi-circular and configured to encapture, and in some instances engage with and/or support a portion of the circumference of the shaft of an arrow. Although depicted as semi-circular, recess 127 may have other shapes (e.g., triangular, rectangular, pentagonal) in other embodiments. Slots 350 and 351 facilitate adjustable positioning of upper tab 120 along the longitudinal axis of a shaft (e.g., shaft 125 and/or shaft 135) and also permit adjustable radial positioning of upper tab 120 with respect to the longitudinal axis of the same shaft to which is it coupled. Upper tab 120 can be constructed of any suitable material including metal, plastic, and wood, among others. In some embodiments, all or some portions of upper tab 120 may be coated with one or more materials to reduce noise, reduce friction, and/or reduce reflection of light. For example, recess 127 may be coated with plastic, rubber, or felt to reduce noise that may occur during contact with the shaft of an arrow. In some embodiments, upper tab 120 may employ holes like those of lower tab 130, rather than slots 350 and 351.

Figure 8B:
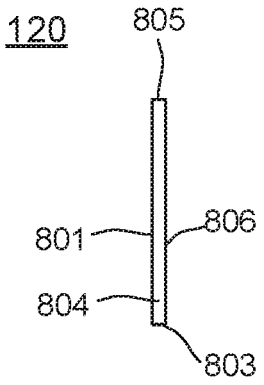
FIG. 8B shows a right side view of the upper tab of the arrow rest of FIG. 3A, in accordance with various aspects of the present disclosure.

FIG. 8B shows a right side view of the upper tab 120 of the arrow rest 100 of FIG. 3A, in accordance with various aspects of the present disclosure. The left side view is a mirror image of the right side view. The right side view shows the rear surface 806 of upper tab 120.

Figure 9A:
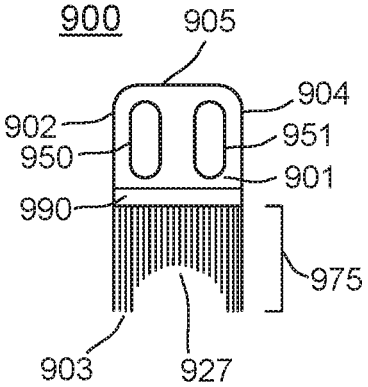
FIG. 9A shows a front view of an example upper/lower tab usable with the arrow rest of FIG. 3A, in accordance with various aspects of the present disclosure.

FIG. 9A shows a front view of an example upper/lower tab 900 usable with the arrow rest 100 of FIG. 3A, in accordance with various aspects of the present disclosure. The rear view is substantially the same. It should be appreciated that tab 900 may be utilized on one or both of the upper shaft 125 and the lower shaft 135 of arrow rest 100. Upper/lower tab 900 is somewhat rectangular in shape, except for recess 927, and may have one or more rounded corners. Upper/lower tab 900 includes a front surface 901, a left edge surface 902, a bottom edge surface 903 (formed by the distal end portions of a plurality of bristles 975), a right edge surface 904, and a top edge surface 905. Recess 927 is semi-circular and formed by the distal ends of bristles 975. Bristles 975 are similar to bristles on a whisk broom and may be made of any suitable material such as straw, plastic, or metal, among others. While flexible, bristles 975 provide enough stiffness to support an arrow resting upon them. Recess 927 is configured to encapture, and in some instances engage with and/or support a portion of the circumference of the shaft of an arrow. Binding 990 holds bristles 975 securely in place on upper/lower tab 900. Slots 950 and 951 facilitate adjustable positioning of upper/lower tab 900 along the longitudinal axis of a shaft (e.g., shaft 125) and also permit adjustable radial positioning of upper/lower tab 900 with respect to the longitudinal axis of the same shaft. Upper/lower tab 900 can be constructed of any suitable material including metal, plastic, and wood, among others. In some embodiments, all or some portions of upper/lower tab 900 may be coated with one or more materials to reduce noise, reduce friction, and/or reduce reflection of light. For example, portions of bristles 975 which form recess 927 or other portions of upper lower/tab 900 may be coated with plastic, rubber, or felt to reduce noise that may occur during contact with the shaft of an arrow. In some embodiments, upper/lower tab 900 may employ holes like those of lower tab 130, rather than slots 950 and 951. In some embodiments, recess 927 may not exist and instead bristles 975 may be of a uniform length. In other embodiments, recess 927 may be another shape than depicted, such as a square notch or a triangular notch.

Figure 9B:
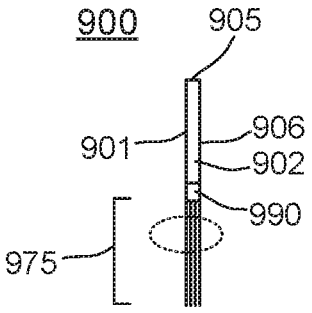
FIG. 9B shows a right side view of the example upper/lower tab illustrated in FIG. 9A, in accordance with various aspects of the present disclosure.

FIG. 9B shows a right side view of the example upper/lower tab 900 illustrated in FIG. 9A, in accordance with various aspects of the present disclosure. The left side view is a mirror image of the right side view. Rear surface 906 is visible and is similar or identical to front surface 901.

Figure 10A:
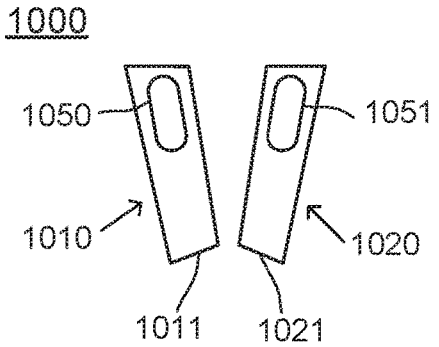
FIG. 10A shows a front view of an example set of upper/lower tabs usable with the arrow rest of FIG. 3A, in accordance with various aspects of the present disclosure.

FIG. 10A shows a front view of an example set of upper/lower tabs 1000 usable with the arrow rest of FIG. 3A, in accordance with various aspects of the present disclosure. Tab 1010 is trapezoidal in shape and has a bottom surface 1011 configured for engaging with the shaft of an arrow and for forming part of an aperture, similar to aperture 160. Slot 1050 facilitates adjustable positioning of tab 1010 along the longitudinal axis of a shaft (e.g., shaft 125) and also permits adjustable radial positioning of tab 1010 with respect to the longitudinal axis of the same shaft. Tab 1020 is trapezoidal in shape and has a bottom surface 1021 configured for engaging with the shaft of an arrow and for forming part of an aperture similar to aperture 160. Slot 1051 facilitates adjustable positioning of tab 1020 along the longitudinal axis of a shaft (e.g., shaft 125) and also permits adjustable radial positioning of tab 1020 with respect to the longitudinal axis of the same shaft. Tabs 1010 and 1020 can be constructed of any suitable material including metal, plastic, and wood, among others. In some embodiments, all or some portions of tabs 1010 and 1020 may be coated with one or more materials to reduce noise, reduce friction, and/or reduce reflection of light. For example, one or more portions of tab 1010 and/or tab 1020 may be coated with plastic, rubber, or felt to reduce noise that may occur during contact with the shaft of an arrow. In some embodiments, tabs 1010 and 1020 may employ holes like those of lower tab 130, rather than slots 1050 and 1051.

Figure 10B:
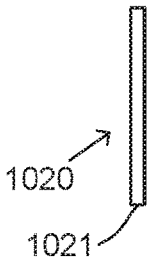
FIG. 10B shows a right side view of one of the tabs illustrated in FIG. 10A, in accordance with various aspects of the present disclosure.

FIG. 10B shows a right side view of tab 1020 illustrated in FIG. 10A, in accordance with various aspects of the present disclosure. The left side view of tab 1010 is identical to the right side view of tab 1020.

Figure 10C:
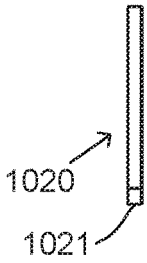
FIG. 10C shows a left side view of one of the tabs illustrated in FIG. 10A, in accordance with various aspects of the present disclosure.

FIG. 10C shows a left side view of tab 1020 illustrated in FIG. 10A, in accordance with various aspects of the present disclosure. The right side view of tab 1010 is identical to the left side view of tab 1020.

Figure 11A:
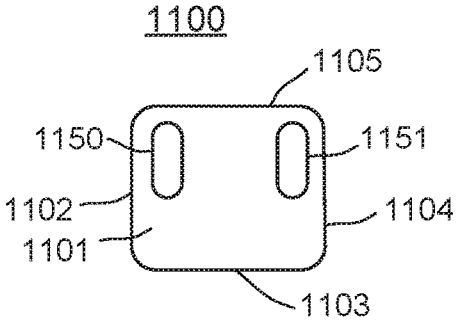
FIG. 11A shows a front view of an example thumb tab usable with the arrow rest of FIG. 3A, in accordance with various aspects of the present disclosure.

FIG. 11A shows a front view of an example thumb tab 1100 usable with the arrow rest of FIG. 3A, in accordance with various aspects of the present disclosure. The rear view is substantially the same. It should be appreciated that thumb tab 1100 may be used in place in concert with another tab or tabs on a shaft such as shaft 125. Thumb tab 1100 does not engage with the shaft of an arrow, but instead serves to provide an extended lower portion of a lower arm (e.g., arm 136) against which a user may press a thumb to cause rotation of the arms of arrow rest 100. Thumb tab 1100 is somewhat rectangular in shape and may have one or more rounded corners. Thumb tab 1100 includes a front surface 1101, a left edge surface 1102, a bottom edge surface 1103, a right edge surface 1104, and a top edge surface 1105. Slots 1150 and 1151 facilitate adjustable positioning of thumb tab 1100 along the longitudinal axis of a shaft (e.g., shaft 135) and also permit adjustable radial positioning of thumb tab 1100 with respect to the longitudinal axis of the same shaft. Thumb tab 1100 can be constructed of any suitable material including metal, plastic, and wood, among others. In some embodiments, all or some portions of thumb tab 1100 may be coated with one or more materials to reduce noise, increase friction with a user's thumb, and/or reduce reflection of light. In some embodiments, thumb tab 1100 may employ holes like those of lower tab 130, rather than or in addition to slots 1150 and 1151.

Figure 11B:
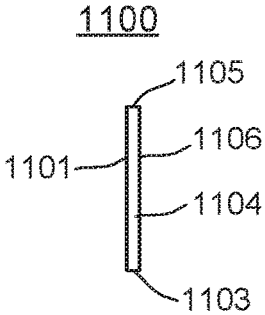
FIG. 11B shows a right side view of the example thumb tab illustrated in FIG. 11A, in accordance with various aspects of the present disclosure.

FIG. 11B shows a right side view of the example thumb tab 1100 illustrated in FIG. 11A, in accordance with various aspects of the present disclosure. The left side view is a mirror image of the right side view. Rear surface 1106 is visible and is similar or identical to front surface 1101.

Figure 12A:
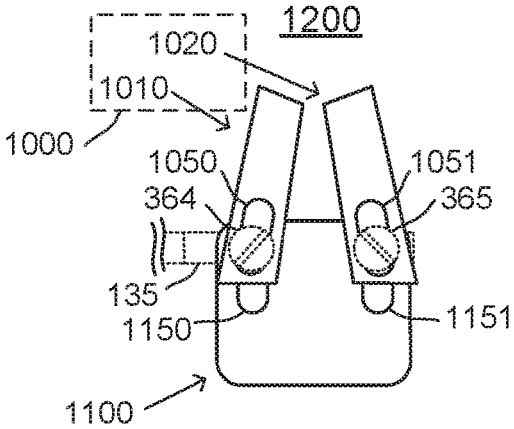
FIG. 12A shows a front view of an example assembly of thumb tab of FIG. 11A and the set of tabs of FIG. 10A mounted on a common shaft of the arrow rest of FIG. 3A, in accordance with various aspects of the present disclosure.

FIG. 12A shows a front view of an example assembly 1200 of thumb tab 1100 of FIG. 11A and the set of tabs 1000 of FIG. 10A mounted on a common shaft 135 of the arrow rest 100 of FIG. 3A, in accordance with various aspects of the present disclosure. Shaft 135 and screws 364 and 365 are shown in broken line as they may not be part of the assembly in some embodiments. Although thumb tab 1100 is shown closest to shaft 135, tabs 1010 and 1020 may be disposed closest to shaft 135 in other embodiments.

Figure 12B:
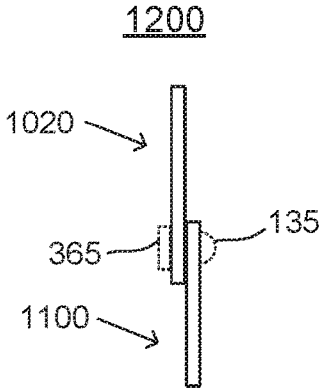
FIG. 12B shows a right side view of the example assembly of thumb tab and set of tabs illustrated in FIG. 12A, in accordance with various aspects of the present disclosure.

FIG. 12B shows a right side view of the example assembly of thumb tab 1100 and set of tabs 1000 illustrated in FIG. 12A, in accordance with various aspects of the present disclosure.

Figure 13A:
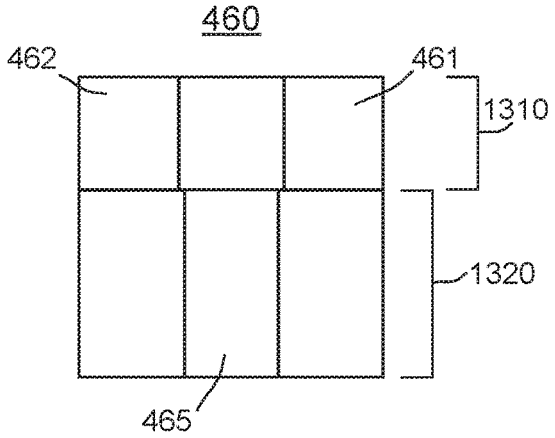
FIG. 13A illustrates a front view of the cam illustrated in FIGS. 4C, 4D, 5C, and 6C, in accordance with various aspects of the present disclosure.

FIG. 13A illustrates a front view of the cam 460 illustrated in FIGS. 4C, 4D, 5C, and 6C, in accordance with various aspects of the present disclosure. Rotor 1310 and barrel 1320 are readily visible as are surfaces 461 and 462 of rotor 1310 and detent 465 which is configured as a recess into barrel 1320.

Figure 13B:
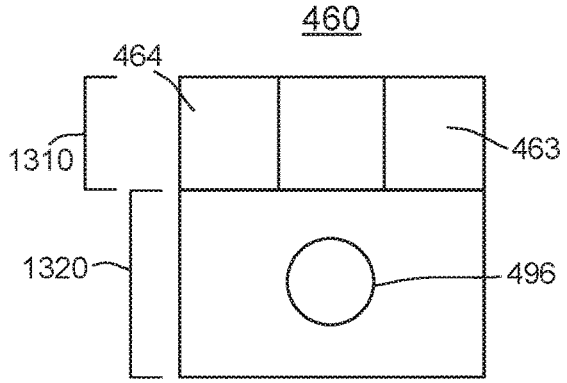
FIG. 13B illustrates a rear view of the cam of FIG. 13A, in accordance with various aspects of the present disclosure.

FIG. 13B illustrates a rear view of the cam 460 of FIG. 13A, in accordance with various aspects of the present disclosure. Surfaces 463 and 464 of rotor 1310 are visible as is the threaded hole 496 which is disposed in barrel 1320 opposite of detent 465.

Figure 13C:
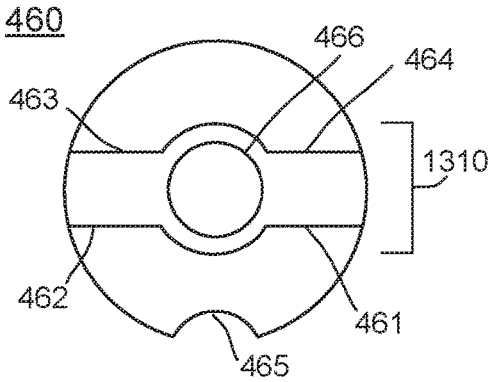
FIG. 13C illustrates a top view of the cam of FIG. 13A, in accordance with various aspects of the present disclosure.

FIG. 13C illustrates a top view of the cam 460 of FIG. 13A, in accordance with various aspects of the present disclosure. Thru hole 466 is visible in this view.

Figure 13D:
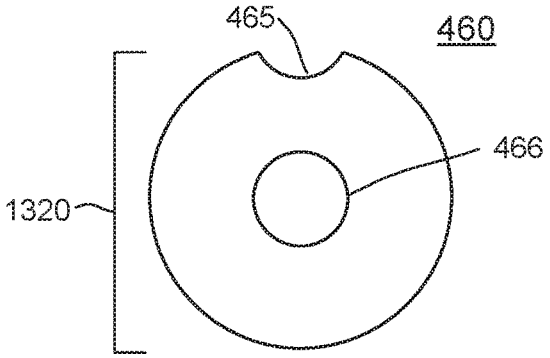
FIG. 13D illustrates a bottom view of the cam of FIG. 13A, in accordance with various aspects of the present disclosure.

FIG. 13D illustrates a bottom view of the cam 460 of FIG. 13A, in accordance with various aspects of the present disclosure.

Figure 13E:
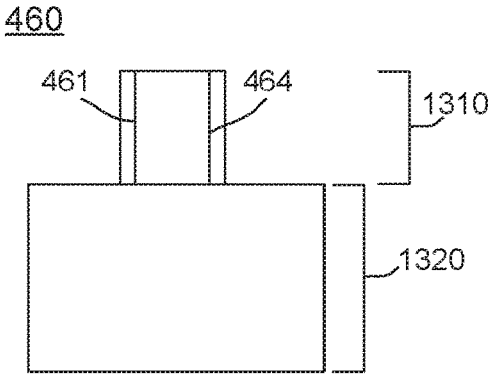
FIG. 13E illustrates a right side view of the cam of FIG. 13A, in accordance with various aspects of the present disclosure.

FIG. 13E illustrates a right side view of the cam 460 of FIG. 13A, in accordance with various aspects of the present disclosure.

Figure 13F:
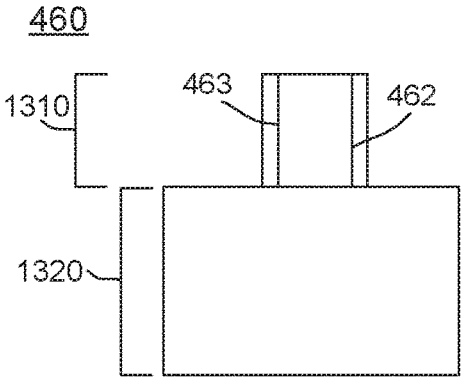
FIG. 13F illustrates a left side view of the cam of FIG. 13A, in accordance with various aspects of the present disclosure.

FIG. 13F illustrates a left side view of the cam 460 of FIG. 13A, in accordance with various aspects of the present disclosure.

Figure 13G:
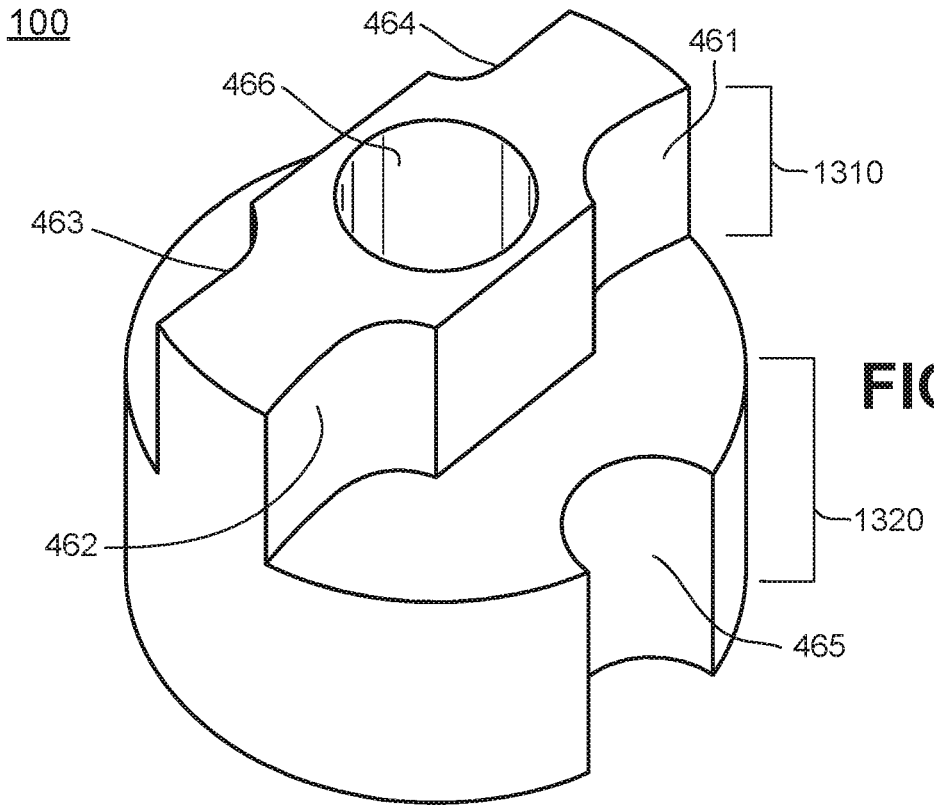
FIG. 13G illustrates an upper left front perspective view of the cam of FIG. 13A, in accordance with various aspects of the present disclosure.

FIG. 13G illustrates an upper left front perspective view of the cam 460 of FIG. 13A, in accordance with various aspects of the present disclosure.

Figure 13H:
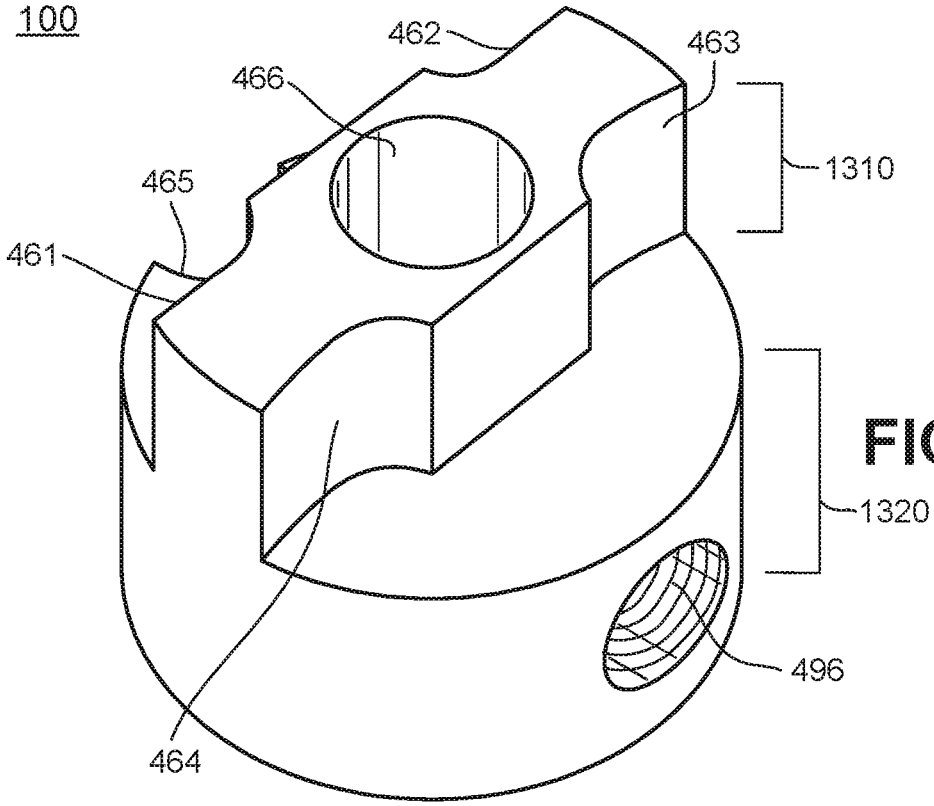
FIG. 13H illustrates a left rear perspective view of the cam of FIG. 13A, in accordance with various aspects of the present disclosure.

FIG. 13H illustrates a left rear perspective view of the cam 460 of FIG. 13A, in accordance with various aspects of the present disclosure.

Figure 14:
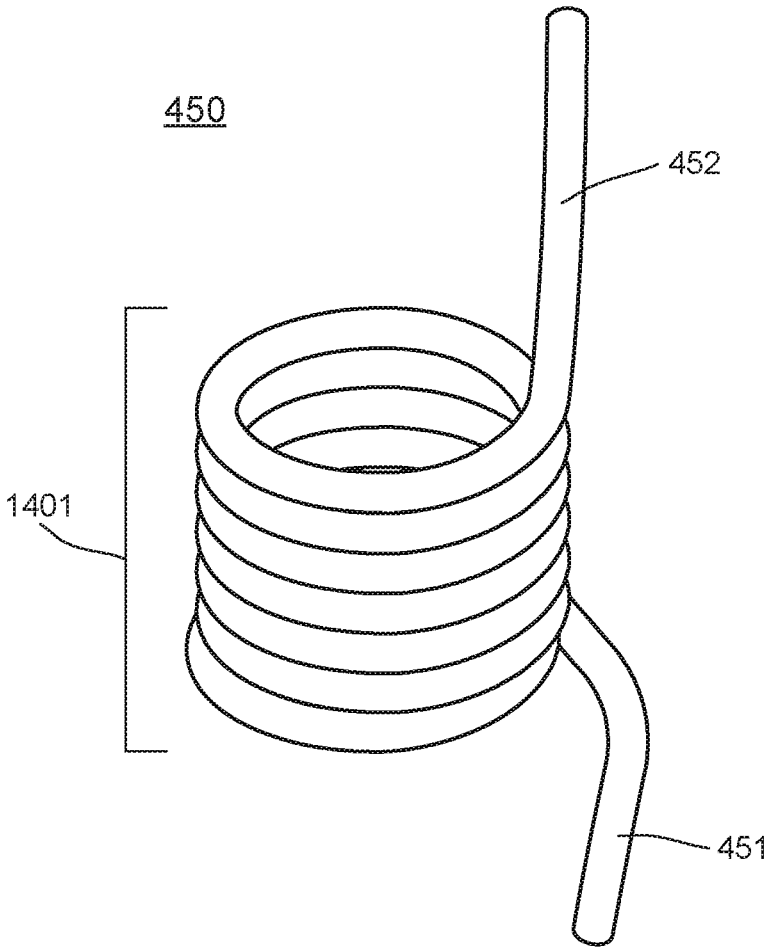
FIG. 14 illustrates a perspective view of the torsion spring illustrated in FIGS. 4C, 4D, 5C, and 6C, in accordance with various aspects of the present disclosure.

FIG. 14 illustrates a perspective view of the torsion spring 450 illustrated in FIGS. 4C, 4D, 5C, and 6C, in accordance with various aspects of the present disclosure. As can be seen torsion spring 450 comprises a set of coils 1401, a first leg 451, and a second leg 452. In the depicted body, first leg 451 and second leg 452 are in perpendicular or nearly perpendicular planes with respect to one another.

Figure 15A:
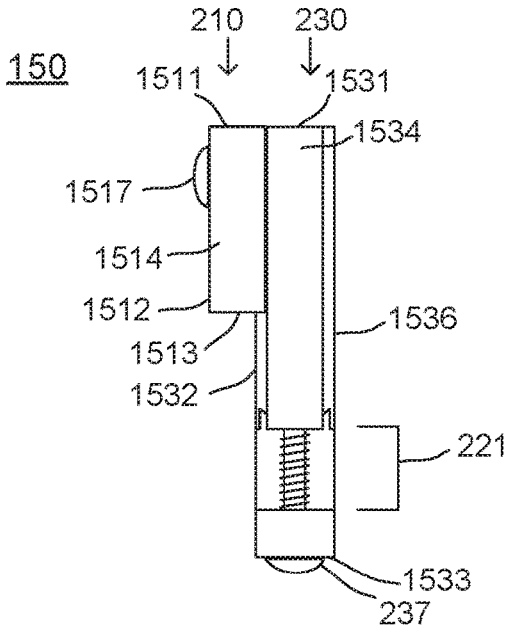
FIG. 15A illustrates a front view of a mount useable to mount an arrow rest to a bow in accordance with various aspects of the present disclosure.

FIG. 15A illustrates a front view of a mount 150 (also referred to herein as arrow rest mount 150) useable to mount an arrow rest 100 to a bow (e.g., bow 170) in accordance with various aspects of the present disclosure. It should be appreciated that other accessories besides arrow rest 100 may be mounted to a bow using mount 150. Mount 150 comprises a first limb 210 and a second limb 230 which are arranged at right angles to one another and adjustably fixed in place in a desired relationship by means of screw 1517. Limb 210 has a top surface 1511, a left side surface 1512, a bottom surface 1513, a right side surface 1516 (visible in FIG. 15B), a front surface 1514, and a rear surface 1515 (visible in FIG. 15B). Limb 230 has a top surface 1531, a left side surface 1532, a bottom surface 1533, a right side surface 1536, a front surface 1534, and a rear surface 1535 (visible in FIG. 15B). A screw 237 which spans socket 221 may be tightened to compress socket 221 onto a rail/tail (see e.g., rail/tail 211 in FIG. 2B) of an accessory which is being mounted in order to removably fix the relationship of the mounted accessory (e.g., arrow rest 100) and mount 150 in a desired location/arrangement with respect to one another.

Figure 15B:
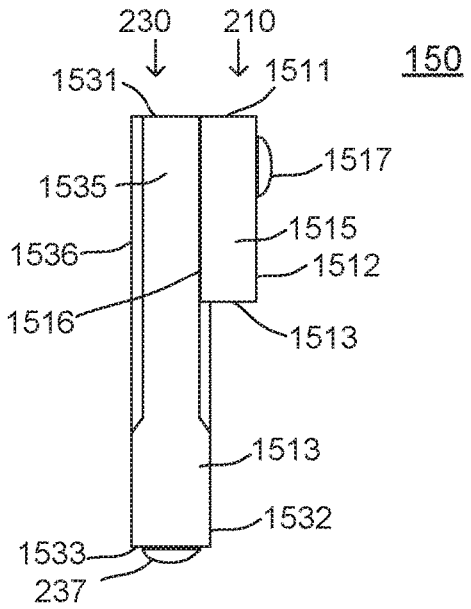
FIG. 15B illustrates a rear view of the mount of FIG. 15A, in accordance with various aspects of the present disclosure.

FIG. 15B illustrates a rear view of the mount 150 of FIG. 15A, in accordance with various aspects of the present disclosure. Right side surface 1516 and rear surface 1515 are visible in this rear view.

Figure 15C:
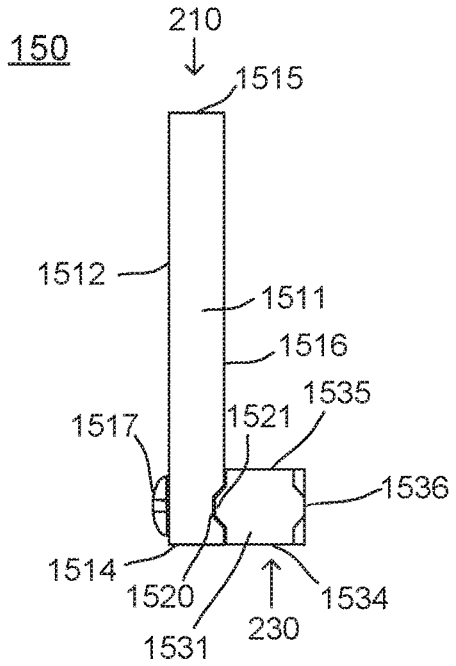
FIG. 15C illustrates a top view of the mount of FIG. 15A, in accordance with various aspects of the present disclosure.

FIG. 15C illustrates a top view of the mount 150 of FIG. 15A, in accordance with various aspects of the present disclosure. From this view, an indentation 1520 in limb 210 is illustrated which engages with a protrusion 1521 in limb 230.

Figure 15D:
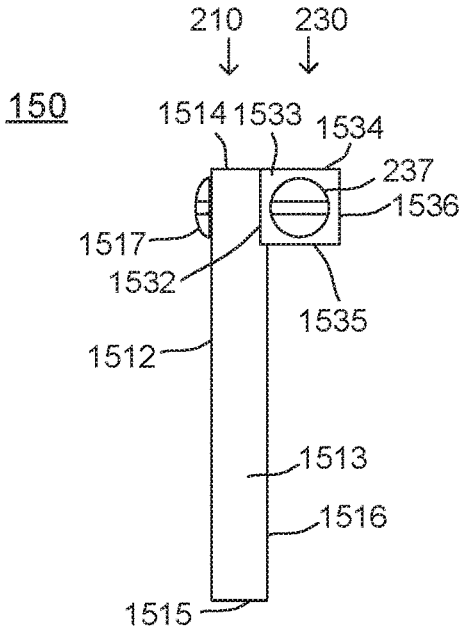
FIG. 15D illustrates a bottom view of the mount of FIG. 15A, in accordance with various aspects of the present disclosure.

FIG. 15D illustrates a bottom view of the mount 150 of FIG. 15A, in accordance with various aspects of the present disclosure.

Figure 15F:
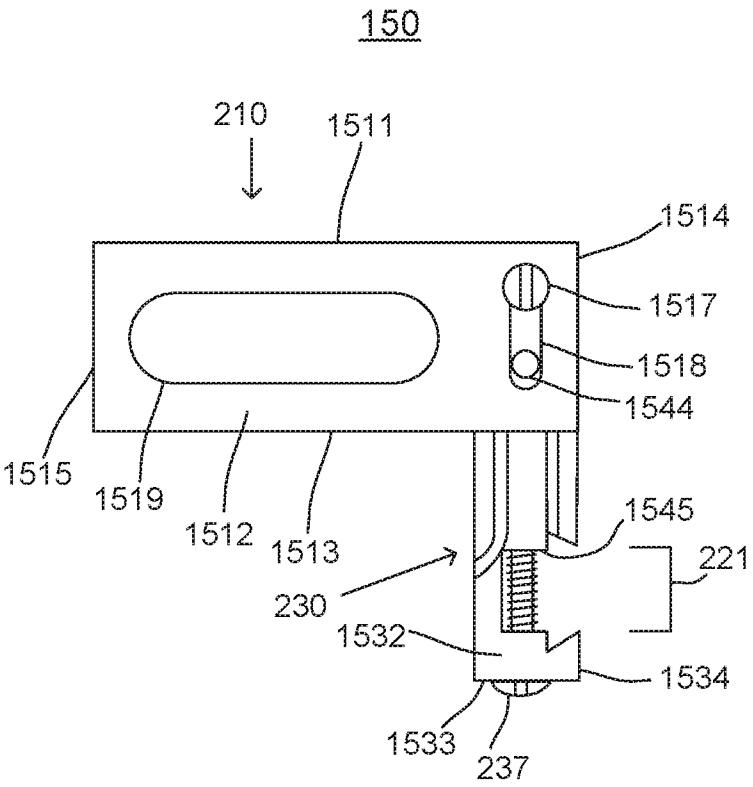
FIG. 15F illustrates a left side view of the mount of FIG. 15A, in accordance with various aspects of the present disclosure.
Figure 15E:
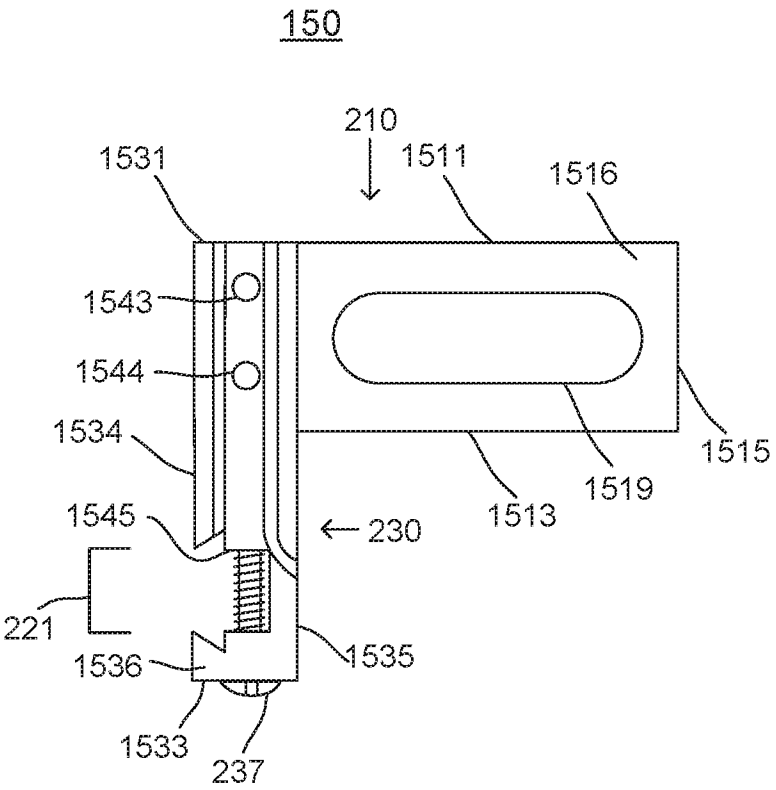
FIG. 15E illustrates a right side view of the mount of FIG. 15A, in accordance with various aspects of the present disclosure.

FIG. 15E illustrates a right side view of the mount 150 of FIG. 15A, in accordance with various aspects of the present disclosure. An inner surface 1545 is visible in this view. Screw 237 engages with a threaded hole in surface 1545 in order to compress the opening of socket 221 (when tightened) or release the opening to its normal span (when loosened). Releasing the opening of socket 221 facilitates slidably adjusting the position of the rail/tail of mounted accessory, while compressing the opening of socket 221 fixes the place of the rail/tail of the mounted accessory in the socket 221. Oval shaped opening 1519 permits adjustable engagement of mount 150 to mounting holes in a bow (e.g., threaded mounting hole 180 of FIG. 1A) by a screw or bolt (not depicted). Threaded holes 1543 and 1544 are thru holes of limb 230 which may be engaged by screw 1517.

FIG. 15F illustrates a left side view of the mount 150 of FIG. 15A, in accordance with various aspects of the present disclosure. Visible on limb 210 is an oval shaped opening 1518, which permits adjustable engagement of limb 210 to limb 230 by screw 1517 being engaged in and tightened into threaded hole 1543 or threaded hole 1544 and then tightened to maintain the desired arrangement of limbs 210 and 230.

Figure 15G:
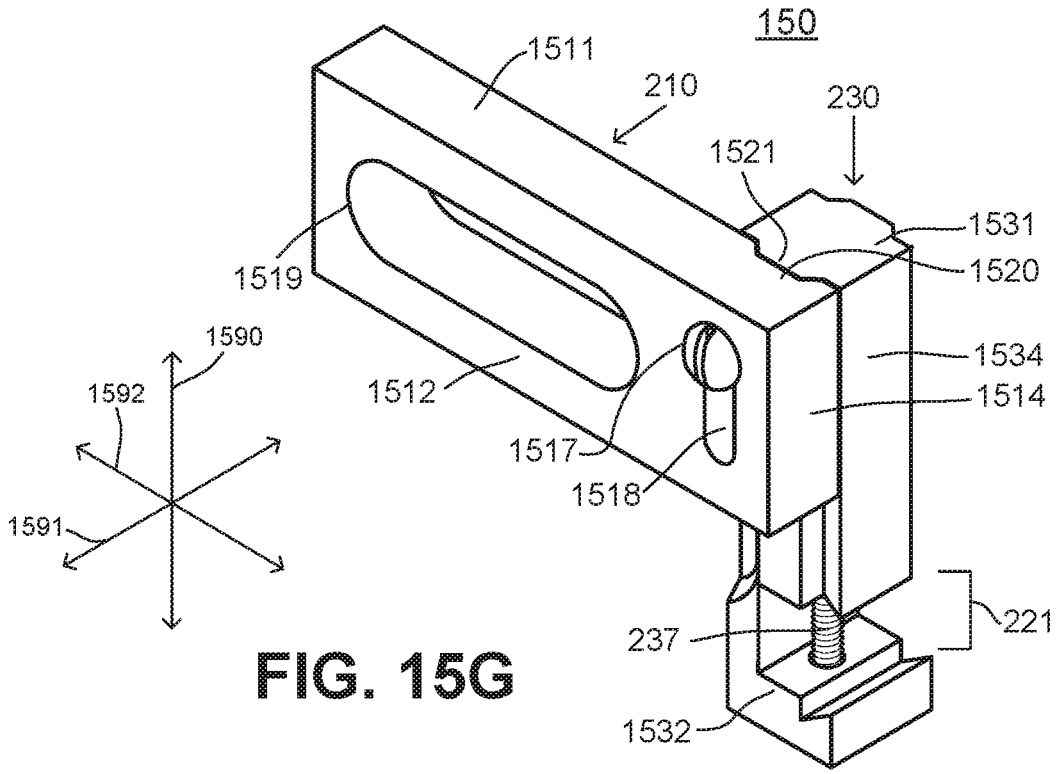
FIG. 15G illustrates an upper left front perspective view of the mount of FIG. 15A, in accordance with various aspects of the present disclosure.

FIG. 15G illustrates an upper left front perspective view of the mount 150 of FIG. 15A, in accordance with various aspects of the present disclosure. Three orthogonal axes 1590, 1591, and 1592 are depicted near mount 150. As previously discussed, mount 150 facilitates three-axis adjustable positioning of a mounted accessory such as arrow rest 100. For example, oval shaped opening 1519 can be slidably adjusted along axis 1592 before being secured with a screw or bolt to a bow to which it is being coupled. For additional adjustability along axis 1592, screw 1517 can be loosened slightly and limb 210 can be rotated 180 degrees and then re-secured to limb 230. Screw 1517 may be selectively positioned in either hole 1543 or hole 1544 and, before being secured, oval shaped opening 1518 facilitates slidable adjustment along axis 1590 of the position of limbs 210 and 230 with respect to one another. Screw 237 allows socket 221 to be compressed or released, and when in a released state socket 221 facilitates slidably adjustment, within socket 221, of the position of the rail/tail of a mounted accessory along axis 1591. For additional adjustability on axis 1591 and/or to operate with a right-handed accessory instead of a left-handed accessory, limb 210 can be affixed to surface 1536 of limb 230 instead of to surface 1532.

Figure 15H:
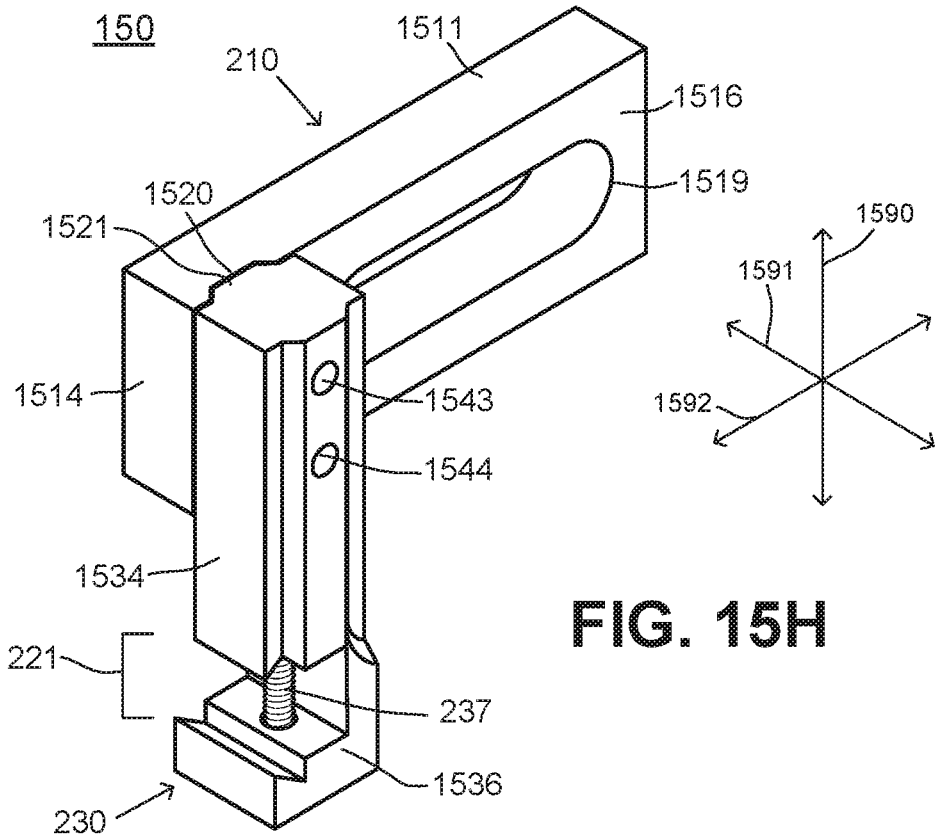
FIG. 15H illustrates an upper right front perspective view of the mount of FIG. 15A, in accordance with various aspects of the present disclosure.

FIG. 15H illustrates an upper right front perspective view of the mount 150 of FIG. 15A, in accordance with various aspects of the present disclosure.

In FIGS. 15A-15H, mount 150 has been depicted with surface 1516 of limb 210 interfacing with surface 1532 of limb 230. However, in other embodiments the arrangement of limbs 210 and 230 may be altered such that surface 1516 of limb 210 instead interfaces with surface 1536 of limb 230. This reconfiguration of arrow rest mount 150 may be accomplished for one or more of a variety of reasons. For example, as currently depicted in FIGS. 15A-15H and elsewhere herein, mount 150 is utilized to mount a component on a left-handed compound bow 170. Rearranging limbs 210 and 230 in the manner described may be accomplished to facilitate using mount 150 to mount a component (e.g., arrow rest 100) on a right-handed compound bow. In other embodiments, rearranging limbs 210 and 230 in the manner described may be accomplished to alter the offset along axis 1591 for a mounted component.

Figure 16:
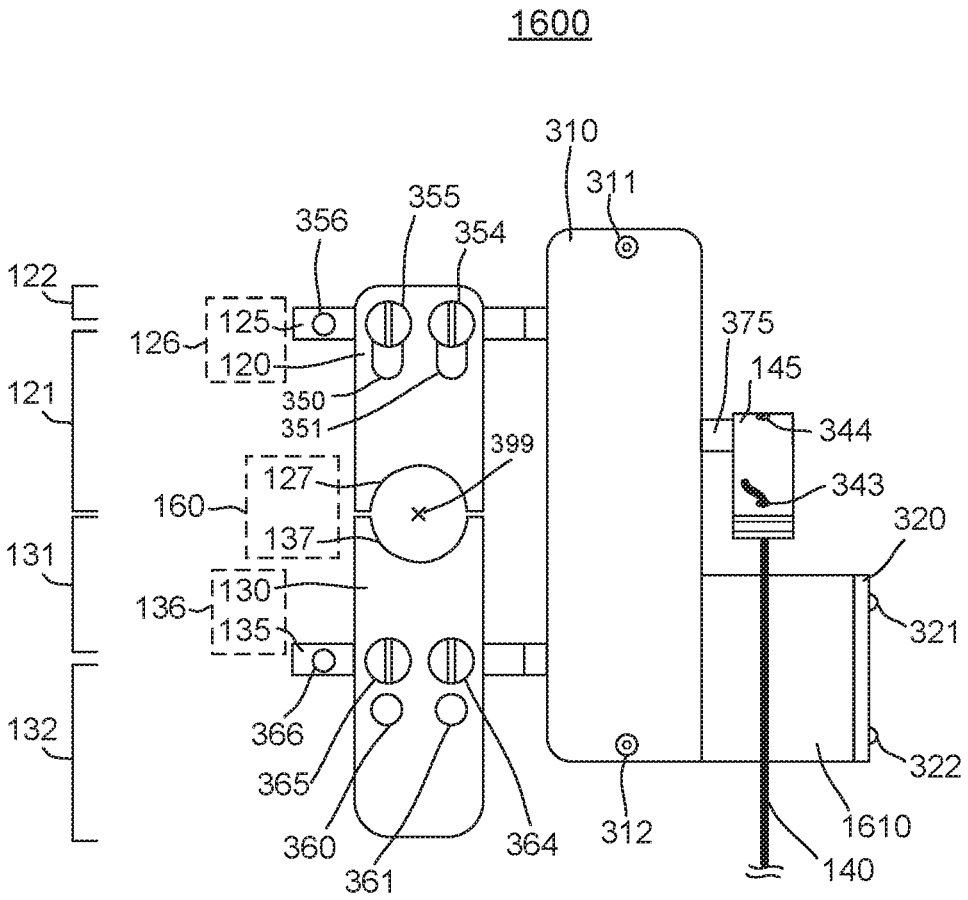
FIG. 16 shows a front view of an arrow rest, in accordance with various aspects of the present disclosure.

FIG. 16 shows a front view of an arrow rest, in accordance with various aspects of the present disclosure. Arrow rest 1600 is similar to arrow rest 100 of FIG. 3A except that it is depicted as a right-handed version instead of the left-handed version depicted in FIG. 3A and elsewhere. In some embodiments, most or all components except for body 110 are interchangeably useable in left handed arrow rest 100 or in right handed arrow rest 1600. In FIG. 16, body 1610 is a mirror image of body 110 depicted in FIG. 3A and elsewhere in the detailed description. Likewise, the functionality and operation of arrow rest 1600 is the same as that of arrow rest 100 except that it operates right handed for use with right handed bows.

CONCLUSION

The examples set forth herein were presented in order to best explain, to describe particular applications, and to thereby enable those skilled in the art to make and use embodiments of the described examples. However, those skilled in the art will recognize that the foregoing description and examples have been presented for the purposes of illustration and example only. The description as set forth is not intended to be exhaustive or to limit the embodiments to the precise form disclosed. Rather, the specific features and acts described above are disclosed as example forms of implementing the claims.

Reference throughout this document to "one embodiment," "certain embodiments," "an embodiment," "various embodiments," "some embodiments," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics of any embodiment may be combined in any suitable manner with one or more other features, structures, or characteristics of one or more other embodiments without limitation.

What is claimed is:

1. An archery bow comprising:

a riser;

a first limb coupled to a first side of the riser;

a second limb coupled to a second side of the riser;

a bow string coupled between the first limb and the second limb; and an arrow rest, the arrow rest adapted to support a shaft of an arrow while a tail section of the arrow engages with the bow string for shooting of the arrow, the arrow rest comprising:

a body coupled with the riser, the body defining a cavity;

a first arm comprising:

a rotatable shaft having a first portion extending from the body and a second portion mounted with and supported by the body; and a tab affixed on the first portion of the rotatable shaft and extending radially outward away from the rotatable shaft, the tab comprising a recess defined in a distal edge thereof and configured to encapture a first portion of a circumference of an arrow shaft when the first arm is rotated to an encapturing configuration of the arrow rest;

a second arm comprising:

a second rotatable shaft coupled by gearing, disposed within the cavity, to the rotatable shaft and operable to rotate in synchronization in an opposite direction to any rotation of the rotatable shaft, the second rotatable shaft having a first portion extending from the body and a second portion mounted with and supported by the body; and a second tab affixed on the first portion of the second rotatable shaft and extending radially outward away from the second rotatable shaft, the second tab comprising a second recess defined in a distal edge thereof and configured to encapture a second portion of the circumference of the arrow shaft when the second tab is rotated to the encapturing configuration of the arrow rest, and wherein, responsive to a portion of the tab and a portion of the second tab being rotated to substantially in plane with one another to achieve the encapturing configuration, the recess and the second recess forming an aperture configured to encapture a circumference of the arrow shaft within the arrow rest, and wherein, responsive to the portion of the tab and the portion of the second tab being rotated to substantially parallel with one another to achieve a discharge configuration of the arrow rest, the aperture opening such that the shaft of the arrow is released from encapture within the arrow rest; and a drive mechanism disposed within the body and coupled with the rotatable shaft, the drive mechanism being operative to urge rotation of the first arm and the second arm from the encapturing configuration to the discharge configuration.

2. The bow of claim 1, wherein the arrow rest further comprises:

a crank arm located external to the body and rotatably coupled to the drive mechanism such that rotation of the crank arm toward the bow string rotates the tab and the second tab toward the encapturing configuration; and a cord secured on a first end to the crank arm and on a second end to one of the bow string and a drive cable of the bow, whereby drawing of the bow string causes movement of the cord to rotate the crank arm toward the bow string.

3. The bow of claim 2, wherein the crank arm is configurable to rotate in a plane that is both parallel to a plane of pull of the bow string and coplanar with the drive cable and the cord when the cord is in a tightened state.

4. The bow of claim 1, wherein the drive mechanism comprises:

a cam coupled with the rotatable shaft; and a biasing means coupled with both the cam and the body and operable to urge rotation of the cam from a first position corresponding with the encapturing configuration of the arrow rest to a second position corresponding with the discharge configuration of the arrow rest.

5. The bow of claim 4, wherein the cam further comprises:

a detent configured into the cam and operable to engage with a spring-loaded ball to releasably hold the cam in the first position against the rotational urge of the biasing means, wherein:

responsive to full draw of the bow string the spring-loaded ball is rotated at least slightly out of the detent; and responsive to firing the arrow from the bow, friction of the detent is overcome by rapid movement of the cam under motivation from the biasing means such that the biasing means rotates the cam to the second position.

6. The bow of claim 1, wherein a center point of the aperture forms a right angle with the bow string, where a vertex of the right angle is at a midpoint of the bow string when the bow is in an undrawn state.

7. The bow of claim 1, wherein the encapturing configuration allows movement of the arrow in a direction along a longitudinal axis of the shaft of the arrow and resists movement of the arrow in any direction orthogonally radial to the longitudinal axis of the shaft of the arrow.

8. The bow of claim 1, wherein the discharge configuration further comprises the portion of the tab and the portion of the second tab being rotated substantially parallel to a shelf of the bow.

9. An arrow rest adapted to support an arrow shaft of an arrow while a tail section of the arrow engages with a bow string of an archery bow for shooting of the arrow, the arrow rest comprising:

a body configured to couple with the archery bow, the body defining a cavity;

a first arm comprising:

a rotatable shaft having a first portion extending from the body and a second portion mounted with and supported by the body; and a tab affixed on the first portion of the rotatable shaft and extending radially outward away from the rotatable shaft, the tab comprising a recess defined in a distal edge thereof and configured to encapture a first portion of a circumference of the arrow shaft when the first arm is rotated to an encapturing configuration of the arrow rest;

a second arm comprising:

a second rotatable shaft coupled by gearing, disposed within the cavity, to the rotatable shaft and operable to rotate in synchronization in an opposite direction to any rotation of the rotatable shaft, the second rotatable shaft having a first portion extending from the body and a second portion mounted with and supported by the body; and a second tab affixed on the first portion of the second rotatable shaft and extending radially outward away from the second rotatable shaft, the second tab comprising a second recess defined in a distal edge thereof and configured to encapture a second portion of the circumference of the arrow shaft when the second tab is rotated to the encapturing configuration of the arrow rest, and wherein, responsive to a portion of the tab and a portion of the second tab being rotated to substantially in plane with one another to achieve the encapturing configuration, the recess and the second recess forming an aperture configured to encapture a circumference of the arrow shaft within the arrow rest, and wherein, responsive to the portion of the tab and the portion of the second tab being rotated to substantially parallel with one another to achieve a discharge configuration of the arrow rest, the aperture opening such that the shaft of the arrow is released from encapture within the arrow rest; and a drive mechanism disposed within the body and coupled with the rotatable shaft, the drive mechanism being operative to urge rotation of the first arm and the second arm from the encapturing configuration to the discharge configuration.

10. The arrow rest of claim 9, wherein the arrow rest further comprises:

a crank arm located external to the body and rotatably coupled to the drive mechanism such that rotation of the crank arm in a first direction rotates the tab and the second tab toward the encapturing configuration.

11. The arrow rest of claim 9, wherein the drive mechanism comprises:

a cam coupled with the rotatable shaft; and a biasing means coupled with both the cam and the body and operable to urge rotation of the cam from a first position corresponding with the encapturing configuration of the arrow rest to a second position corresponding with the discharge configuration of the arrow rest.

12. The arrow rest of claim 11, wherein the cam further comprises:

a detent configured into the cam and operable to engage with a spring-loaded ball to releasably hold the cam in the first position against the rotational urge of the biasing means.

13. The arrow rest of claim 9, wherein the encapturing configuration allows movement of the arrow in a direction along a longitudinal axis of the shaft of the arrow and resists movement of the arrow in any direction orthogonally radial to the longitudinal axis of the shaft of the arrow.

* * * * *